US006619204B2

(12) United States Patent
Mistyurik

(10) Patent No.: US 6,619,204 B2
(45) Date of Patent: Sep. 16, 2003

(54) HAND-HELD LABELER

(75) Inventor: John D. Mistyurik, Troy, OH (US)

(73) Assignee: Paxar Americas, Inc., Dayton, OH (US)

( * ) Notice: Subject to any disclaimer, the term of this patent is extended or adjusted under 35 U.S.C. 154(b) by 0 days.

(21) Appl. No.: 10/326,930

(22) Filed: Dec. 23, 2002

(65) Prior Publication Data

US 2003/0084799 A1 May 8, 2003

Related U.S. Application Data

(60) Division of application No. 09/974,299, filed on Oct. 10, 2001, now Pat. No. 6,516,719, which is a continuation-in-part of application No. 08/909,363, filed on Aug. 11, 1997, now Pat. No. 5,988,249, which is a continuation-in-part of application No. 08/701,259, filed on Aug. 22, 1996, now Pat. No. 5,910,227.

(51) Int. Cl.[7] ..... B41F 31/00

(52) U.S. Cl. ..... 101/335; 101/348; 101/314; 101/288; 156/384; 242/596.5

(58) Field of Search ..... 101/334, 111, 101/288, 290, 291, 292, 293, 328, 368, 348, 314; 156/384, 584, 571, 577, 579; 242/596, 596.1, 596.5

(56) References Cited

U.S. PATENT DOCUMENTS

| | | | | |
|---|---|---|---|---|
| 1,036,200 A | | 8/1912 | Elliott | |
| 3,890,188 A | | 6/1975 | Sams | |
| 3,968,745 A | | 7/1976 | Hamisch, Jr. | |
| 4,013,500 A | | 3/1977 | Koput et al. | |
| 4,044,677 A | * | 8/1977 | Hamisch, Jr. | 101/348 |
| 4,053,345 A | | 10/1977 | Hamisch, Jr. | |
| 4,104,106 A | | 8/1978 | Hamisch, Jr. | |
| 4,119,033 A | | 10/1978 | Sato | |
| 4,125,421 A | | 11/1978 | Hamisch, Jr. | |
| 4,142,932 A | | 3/1979 | Hamisch, Jr. | |
| 4,148,679 A | | 4/1979 | Hamisch, Jr. | |
| 4,158,590 A | | 6/1979 | Hamisch, Jr. | |
| 4,199,392 A | | 4/1980 | Hamisch, Jr. | |
| 4,206,704 A | | 6/1980 | Sato | |
| 4,227,457 A | | 10/1980 | Hamisch, Jr. | |
| 4,252,060 A | | 2/1981 | Strausburg | |
| 4,257,326 A | | 3/1981 | Sato | |
| 4,261,783 A | | 4/1981 | Finke | |
| 4,267,006 A | | 5/1981 | Karn | |
| 4,280,863 A | | 7/1981 | Hamisch, Jr | |
| 4,316,469 A | | 2/1982 | Kapitanov | |
| 4,350,554 A | | 9/1982 | Pabodie | |
| 4,352,710 A | | 10/1982 | Makley | |
| 4,419,930 A | | 12/1983 | Holland-Letz | |
| 4,432,307 A | | 2/1984 | Godin | |
| 4,436,572 A | | 3/1984 | Makley | |
| 4,440,592 A | | 4/1984 | Sato et al. | |
| 4,441,425 A | | 4/1984 | Huggins | |
| 4,450,035 A | | 5/1984 | Hamisch, Jr. | |
| 4,497,682 A | | 2/1985 | Hamisch, Jr. | |

(List continued on next page.)

FOREIGN PATENT DOCUMENTS

JP 6018933 of 1985

*Primary Examiner*—Eugene H. Eickholt
(74) *Attorney, Agent, or Firm*—Joseph J. Grass

(57) ABSTRACT

There is disclosed a hand-held labeler which is easy to load, clean and service. The labeler has a gear driven print head wherein the print head is situated on an upper housing section and the print head is actuated from a lower housing section. The upper housing section can be moved to an open position without interfering with the maintenance of the drive connection with the print head or the advance of a label carrying web through the labeler. An inker enables an ink roller to be easily inserted and removed without ink from the ink roller being transferred to the user's hands. An impression control device has only a small number of parts and is easy to assemble.

5 Claims, 19 Drawing Sheets

U.S. PATENT DOCUMENTS 4,498,389 A * 2/1985 Hamisch, Jr. ..... 101/288
4,527,576 A 7/1985 Chou
4,563,235 A 1/1986 Karn
4,668,326 A 5/1987 Mistyurik
4,697,517 A * 10/1987 Fassman ..... 101/348
4,724,034 A * 2/1988 Becker ..... 156/384
4,785,735 A * 11/1988 Hamisch, Jr. ..... 101/348
4,813,355 A 3/1989 Stork
4,947,747 A * 8/1990 Hermann ..... 101/288
5,013,388 A 5/1991 Goodwin et al.
5,044,276 A 9/1991 Huggins
5,283,921 A 2/1994 Ng
5,486,259 A 1/1996 Goodwin et al.
5,771,799 A * 6/1998 Makino ..... 101/348
5,906,161 A 5/1999 Kessler
5,910,227 A 6/1999 Mistyurik
5,988,249 A 11/1999 Mistyurik

* cited by examiner 24
88
38
89
127
38'
23
66'
66
103
49
25
39
128
39'
82
84
38'
103'
66a
65
66c
39''
66b
101
99
64
100
67''
70
56
146'
64
29
30
32

HAND-HELD LABELER

CROSS-REFERENCE TO RELATED APPLICATION

This application is a continuation-in-part of application Ser. No. 08/909,363 filed Aug. 11, 1997 now U.S. Pat. No. 5,988,249, which is a continuation-in-part of U.S. patent application Ser. No. 08/701,259 now U.S. Pat. No. 5,910,227, filed Aug. 22, 1996, now U.S. Pat. No. 5,910,227. Reference is also made to related application Ser. No. 09/024,142, filed Feb. 17, 1998, now U.S. Pat. No. 5,934,189. This application is a division of Ser. No. 09/974,299 filed on Oct. 10, 2001 and now U.S. Pat. No. 6,516,719.

BACKGROUND OF THE INVENTION

1. Field of the Invention

This invention relates to the field of hand-held labelers.

2. Brief Description of the Prior Art

The following U.S. patents are made of record: U.S. Pat. No. 1,036,200 to Elliot; U.S. Pat. No. 3,890,188 to Sams; U.S. Pat. No. 3,968,745 to Hamisch, Jr.; U.S. Pat. No. 4,104,106 to Hamisch, Jr.; U.S. Pat. No. 4,119,033 to Sato; U.S. Pat. No. 4,125,421 to Hamisch, Jr.; U.S. Pat. No. 4,142,932 to Hamisch, Jr.; U.S. Pat. No. 4,148,679 to Hamisch, Jr.; U.S. Pat. No. 4,227,457 to Hamisch, Jr.; U.S. Pat. No. 4,252,060 to Strausburg; U.S. Pat. No. 4,257,326 to Sato; U.S. Pat. No. 4,280,863 to Hamisch, Jr. et al; U.S. Pat. No. 4,261,783 to Finke; U.S. Pat. No. 4,280,863 to Hamisch, Jr. et al; U.S. Pat. No. 4,350,554 to Pabodie; U.S. Pat. No. 4,352,710 to Makley; U.S. Pat. No. 4,440,592 to Sato; U.S. Pat. No. 4,441,425 to Huggins; U.S. Pat. No. 4,668,326 to Mistyurik; and U.S. Pat. No. 5,486,259 to Goodwin et al; U.S. Pat. No. 5,906,161 to Kessler; and Japanese publication 60-18933.

SUMMARY OF THE INVENTION

This invention relates to an improved, easy to load, simple, low cost, easy to manufacture, user-friendly, durable hand-held labeler for printing and applying pressure sensitive labels.

According to a specific embodiment of the invention, there is provided a hand-held labeler with a housing having an upper housing portion or section and a lower housing portion or section. The upper housing section is movable relative to the lower housing section to allow access to the inside of the housing for loading of labels, for cleaning and for removing stray labels and jams. The upper housing section mounts a print head for reciprocating straight line movement. The lower housing section has a handle and mounts a manually engageable actuator, a toothed driver, gears and a pawl and ratchet mechanism. The actuator, one of the gears and the pawl and ratchet mechanism are operable to advance the driver. There are racks on the print head with mesh with the gears when the upper housing section is in the closed or operating position. However, when the upper housing section is in the open position the racks are out of mesh with the gears. The lower housing section mounts a label roll about an axis and the upper housing section can rotate to its open position about the axis. When the print head is driven into its printing position in cooperation with the print head, an inker arm is cammed so that the ink roller which it carries inks the print head. The upper housing section is releasably latched to the lower housing section. There is an interlock between the print head and the latch to prevent the latch from becoming unlatched unless the print head is essentially in its initial position. The interlock also helps keep the print head from moving out of its initial position when the latch is unlatched. The latch also cooperates with the print head to help guide the print head during movement. There is a movable member in the housing which provides a brake surface, guides the carrier web, mounts a die roll, which partially surrounds the toothed driver, and which has a finger-engageable recess. Another member mounts a brake roll and a direction changing roll. An assembly including the platen and the delaminator is positionable selectively relative to an applicator so that the printer with a minimum of structural change, such as repositioning the applicator, can dispense labels of different lengths into underlying relation to an applicator.

It is a feature of the invention to provide a spring which will return the print head to its initial position even though the upper housing section is in an open position, and yet when the upper housing portion is moved to a closed position with respect to the lower housing portion registration between the component parts continues to exist.

It is a further feature of the invention to provide an improved inker which is simple, easy to manufacture, and wherein an ink roller may be easily inserted and removed without ink from the ink roller being transferred to the user's hands. In particular, the inker includes a carrier having relatively movable holders which cooperate to readily receive an ink roller and from which the ink roller can be readily removed by moving the holders relative to each other.

It is another feature of the invention to provide an improved ink roller which is compatible with at least two types of carriers, and wherein the ink roller is easy to insert and remove from both types of carriers.

It is another feature of the invention to provide an improved impression control mechanism which is effective to promote quality printing, which has few parts, and which is easy to assemble. In particular, a pawl is movable together with the print head as the print head is driven toward the platen in response to operation of an actuator. When the print head and pawl have moved to a position at which the pawl contacts an abutment, movement of the print head is arrested but one or more springs are progressively loaded. Upon a predetermined further amount of movement of the actuator which results in a predetermined loading of the spring or springs, the pawl is tripped by a trip surface, whereupon the spring or springs move the print head into cooperation with the platen at a predetermined rate.

It is yet another feature of the invention to provide an improved latch for latching sections of the housing to each other. The latch is preferably of one-piece molded plastics construction. The latch also forms part of the inker in that the latch has an integral leaf spring which moves the ink roll carrier into inking cooperation with the print head.

BRIEF DESCRIPTION OF THE DIAGRAMMATIC DRAWINGS

Figure 28:
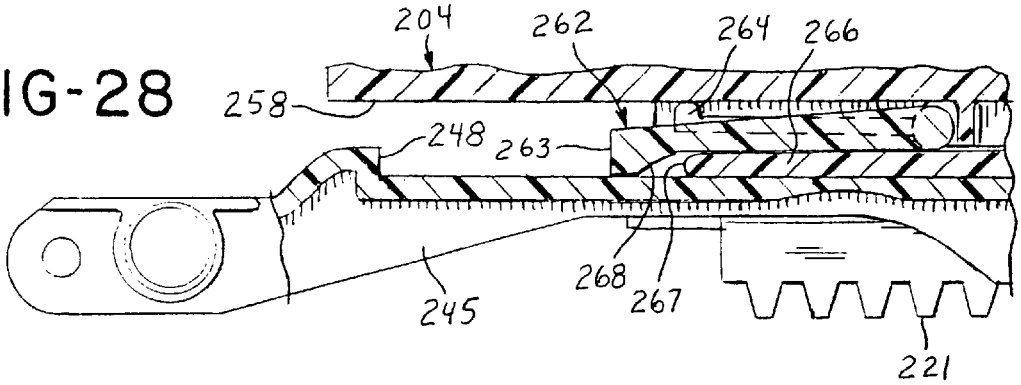
FIG. 28 is an enlarged elevational sectional view showing the print head in its home or initial position with the pawl spaced from the abutment.
Figure 29:
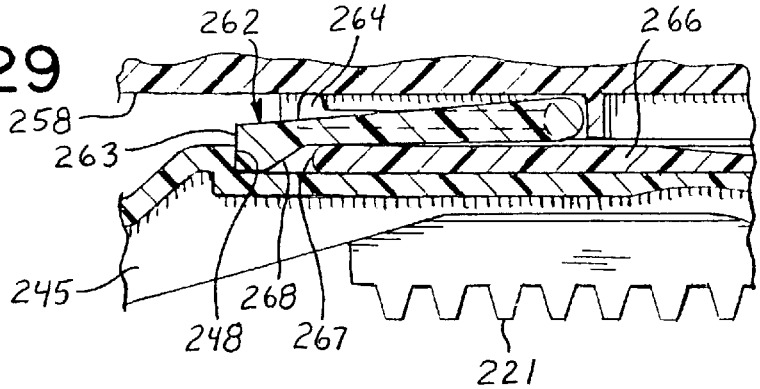
FIG. 29 is a view similar to FIG. 28, but showing the print head having advanced toward the platen and with the pawl engaged or abutting the abutment.
Figure 30:
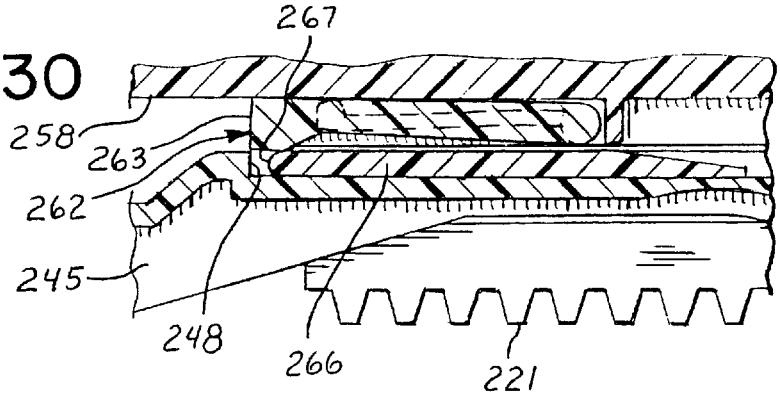
FIG. 30 is a view similar to FIGS. 28 and 29, but showing the pawl at the instant of being tripped by a trip surface.
Figure 31:
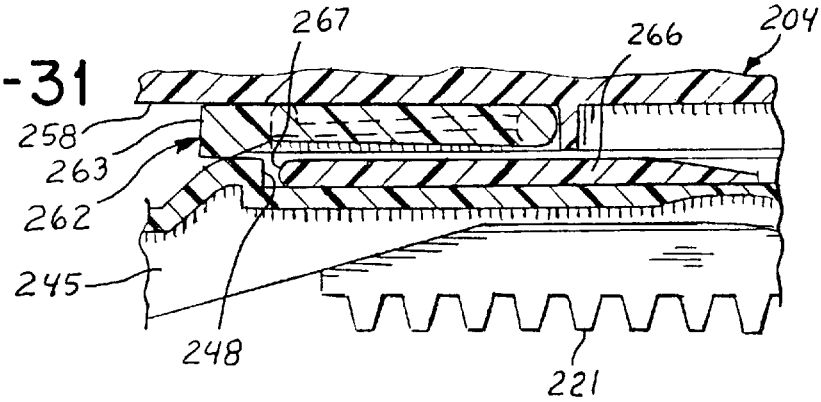
Figure 33:
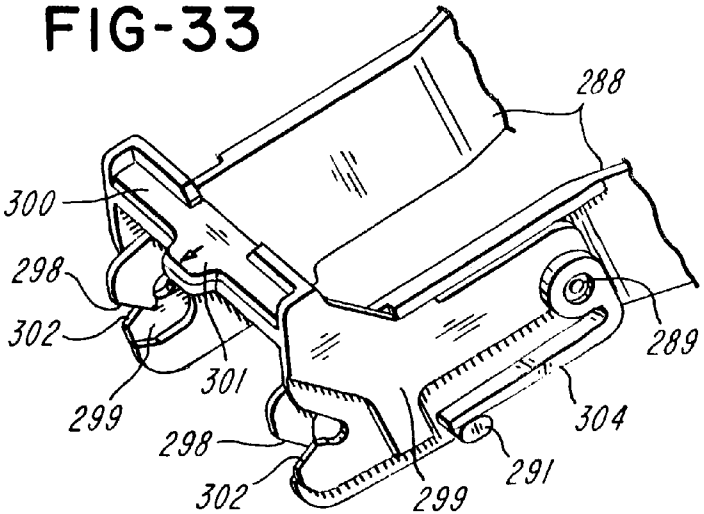
Figure 34:
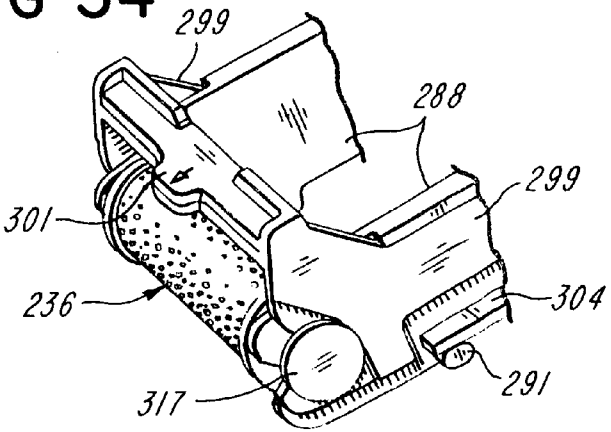
Figure 32:
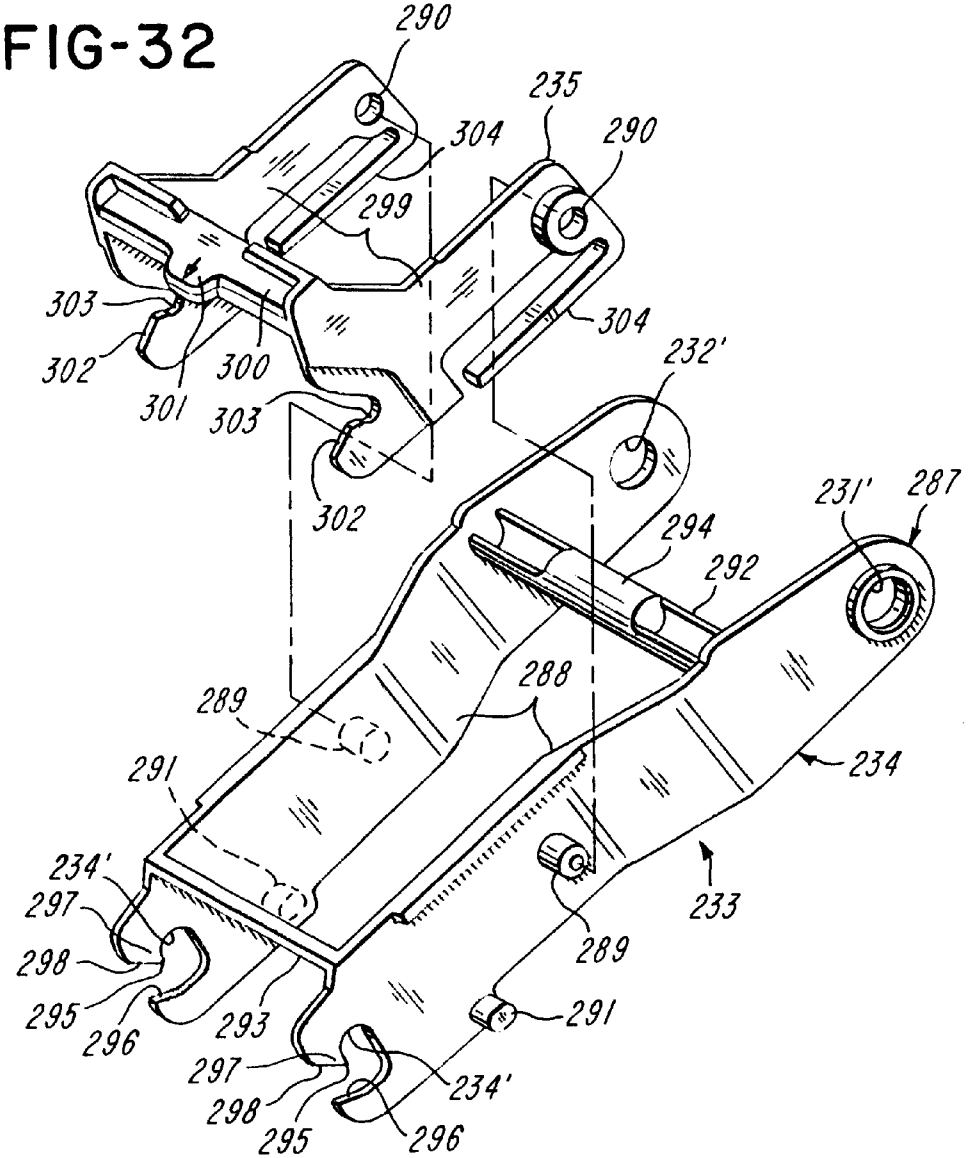
Figure 35:
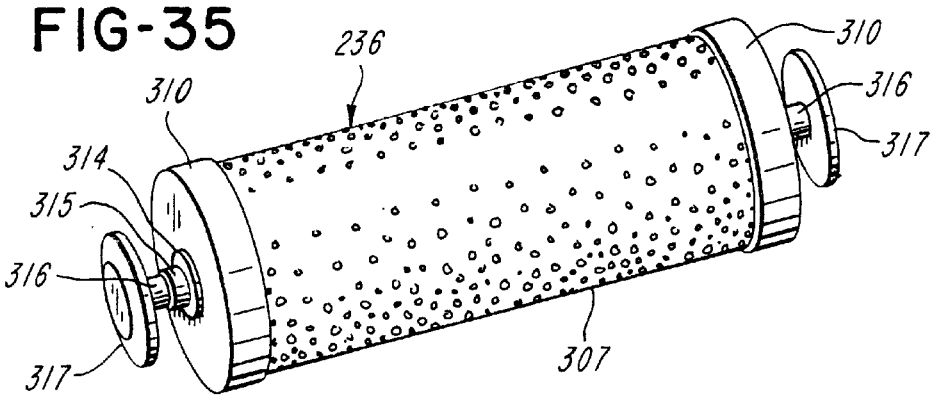
Figure 36:
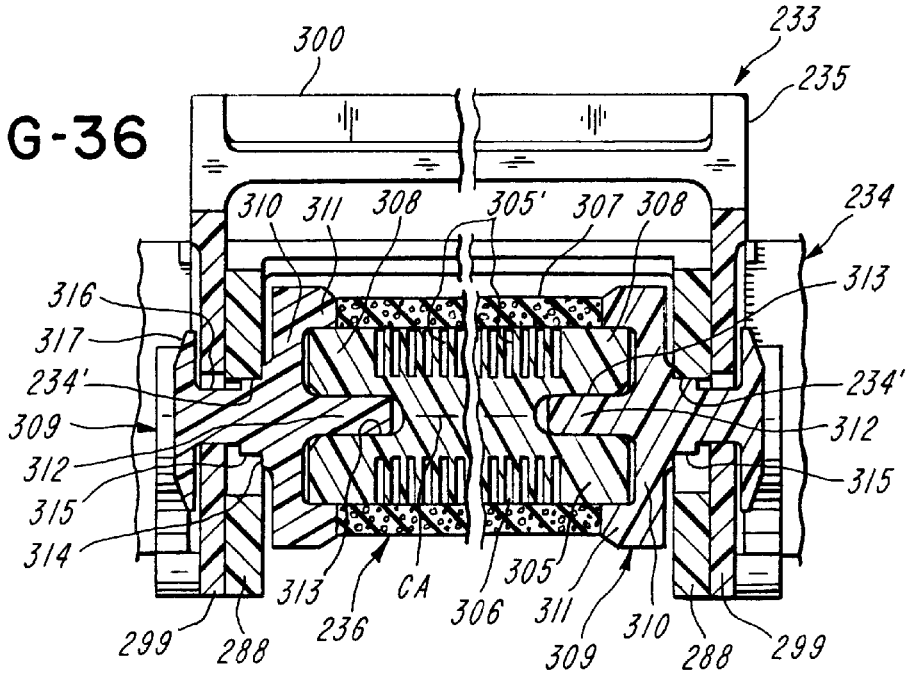
Figure 37:
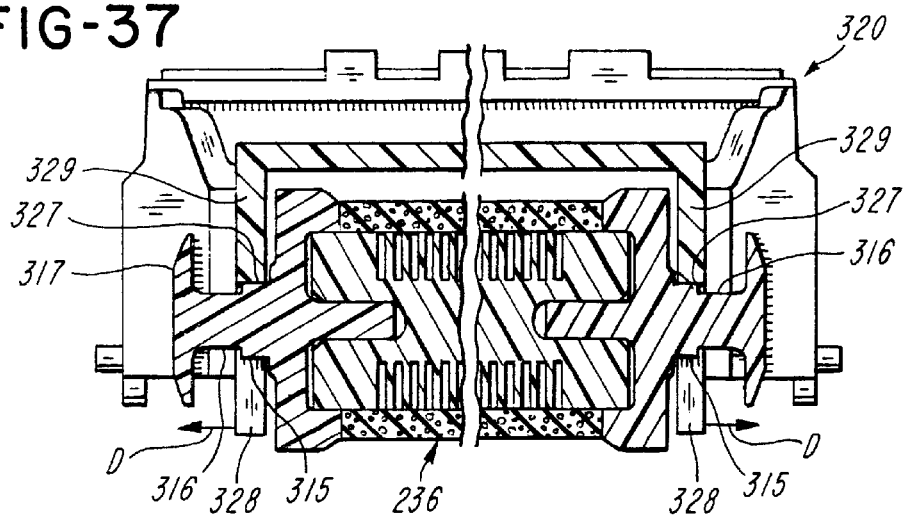
Figure 38:
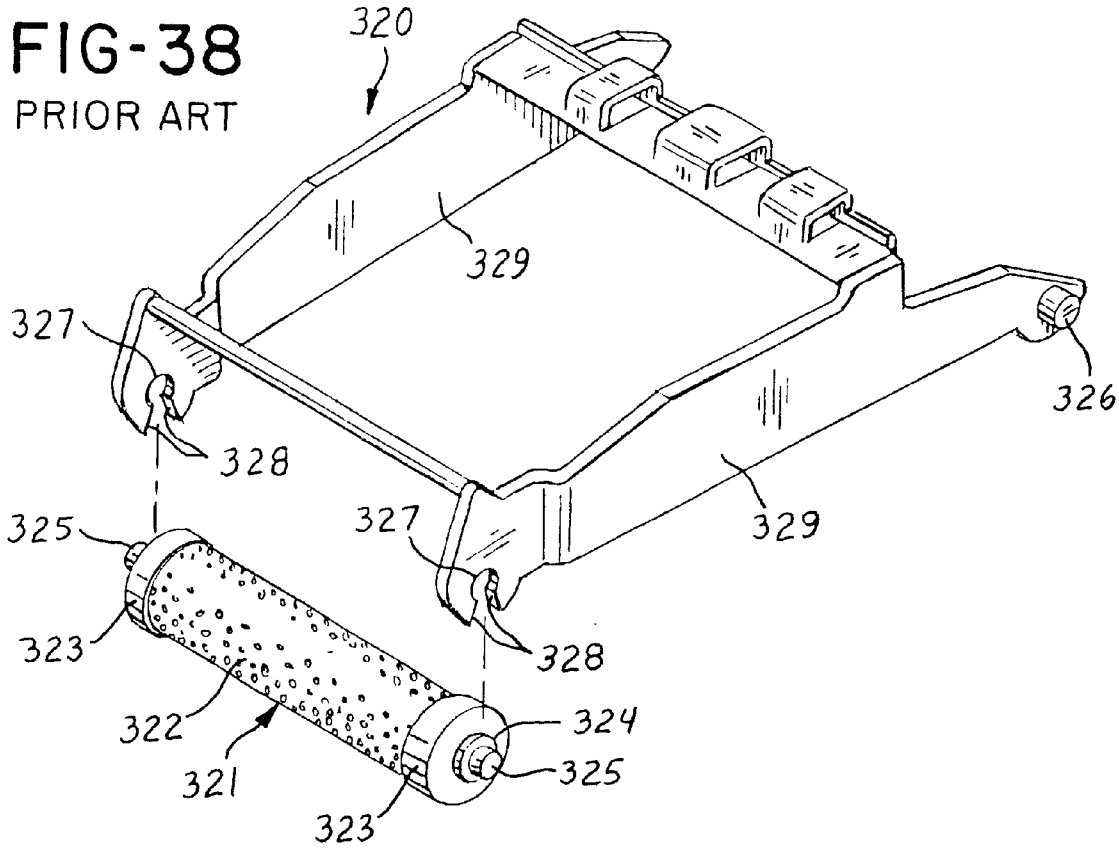
FIG-38 PRIOR ART
Figure 39:
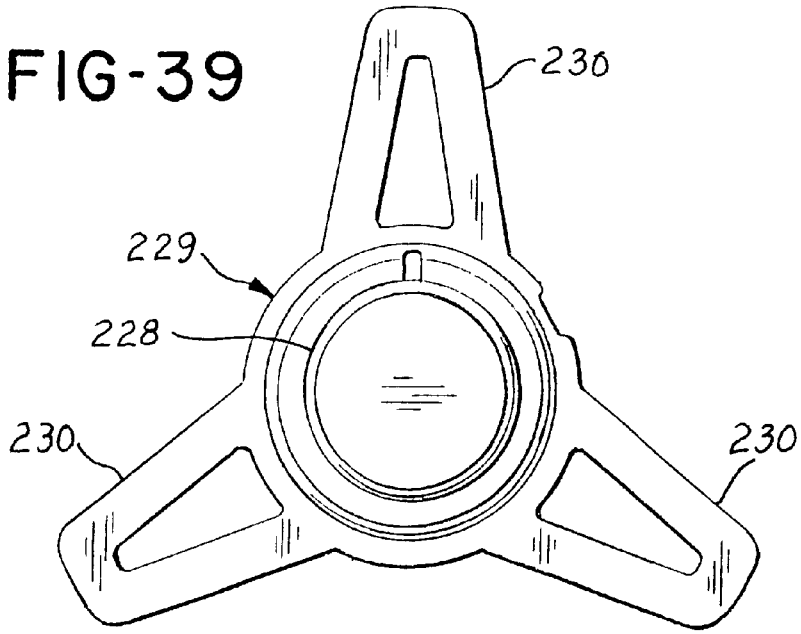

FIG. 31 is a view similar to FIGS. 28 through 30, but showing the print head and the pawl as having advanced beyond their locations shown in FIGS. 28 through 37 and 39;

FIG. 32 is an exploded perspective view of a carrier of an inker used in the embodiment of FIGS. 21 through 37 and 39;

FIG. 33 is an assembled, fragmentary view of the carrier;

FIG. 34 is a fragmentary view of the carrier similar to FIG. 33, but showing an ink roller mounted on the carrier;

FIG. 35 is a perspective view of an ink roller shown in FIG. 34;

FIG. 36 is a sectional view through the carrier and the ink roller;

FIG. 37 is a sectional view of an alternative form of carrier together with the ink roller shown in FIGS. 22 and 34 through 36;

FIG. 38 is a perspective view of a prior art inker including a carrier and an ink roller; and FIG. 39 is an elevational view of one of the discs and its associated mounting members.

DETAILED DESCRIPTION OF A PREFERRED EMBODIMENT

Figure 1:
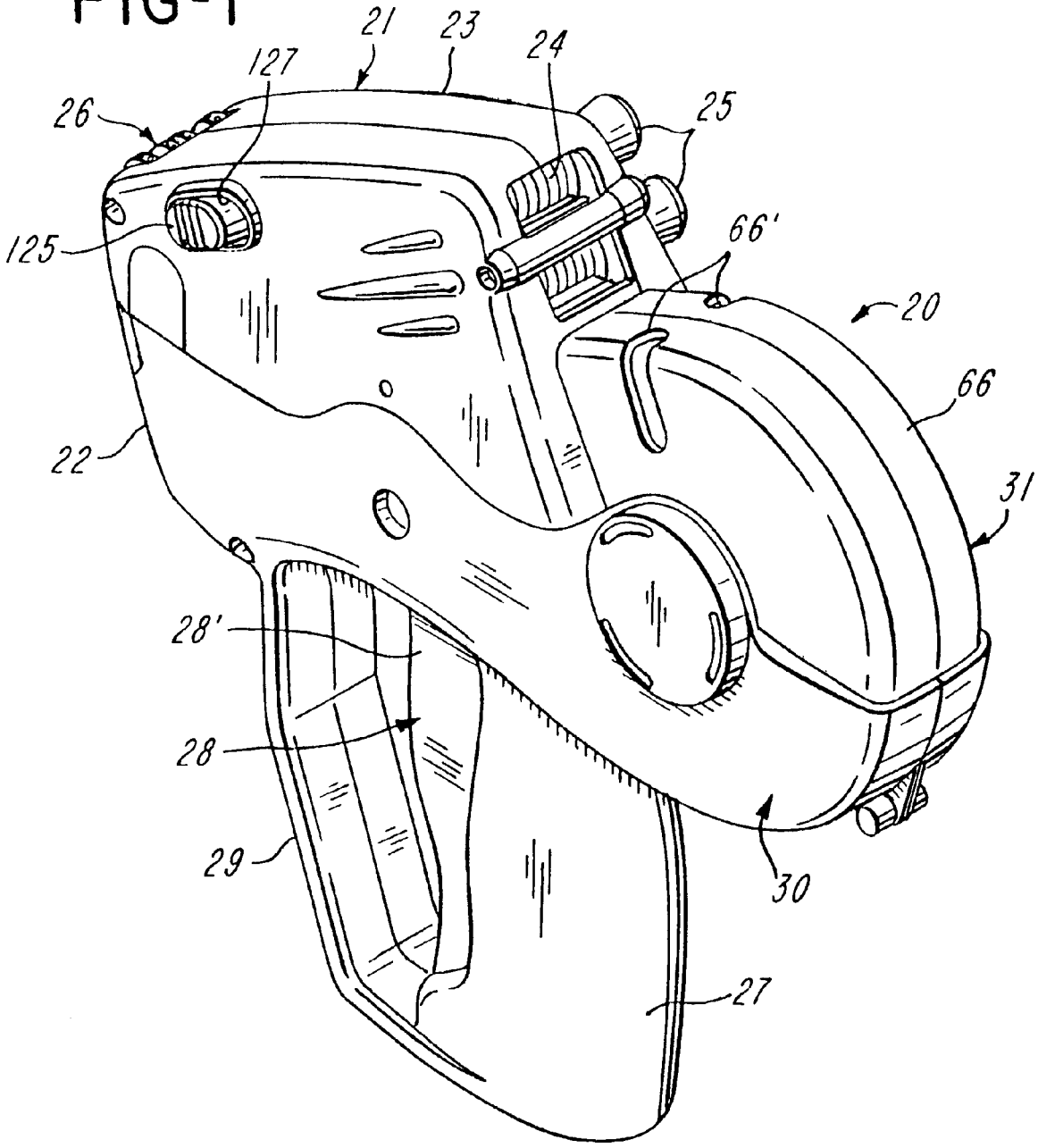
FIG. 1 is a perspective view of a hand-held labeler in accordance with the invention.

With reference to FIG. 1, there is shown hand-held labeler generally indicated at 20. The labeler 20 has a housing or frame generally indicated at 21 having a first or lower housing section or portion 22 and a second or upper housing section or portion 23. The housing 21 mounts a two-line print head 24 having a pair of selectors 25. An applicator generally indicated at 26 is disposed at the upper front portion of the housing 21. The housing 21 has a downwardly extending manually graspable handle 27 at which a manually engageable actuator generally indicated at 28 is disposed. A knuckle guard 29 is connected to the underside of the lower housing section 22 and to the lower end portion of the handle 27. The space between the knuckle guard 29 and the actuator 28 accommodates the user's fingers.

Figure 2:
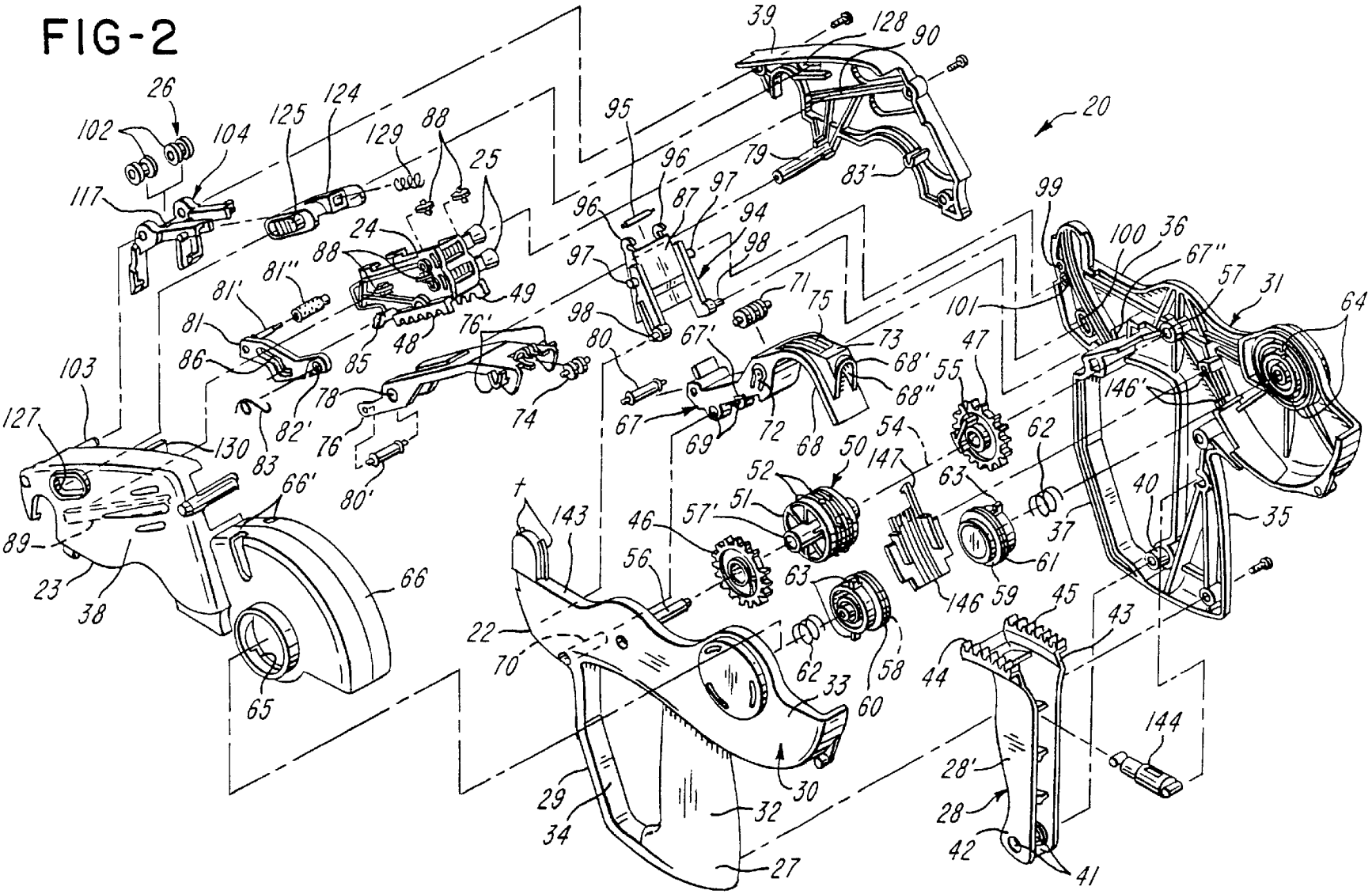
FIG. 2 is an exploded perspective view of the labeler depicted in FIG. 1.
Figure 16:
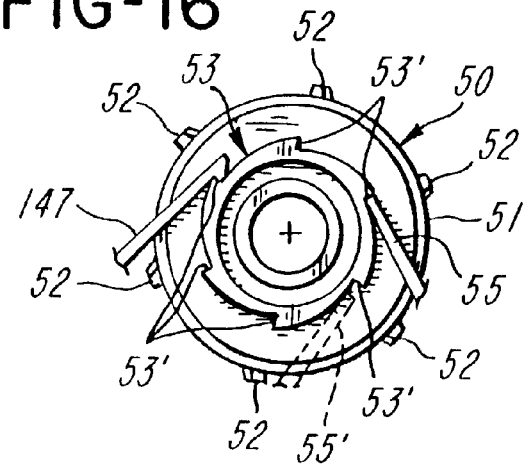
FIG. 16 is a side elevational view of the feed wheel and ratchet wheel and feed and anti-backup pawls.

With reference to FIG. 2, the lower housing section 22 has a left side portion generally indicated at 30 and a right side portion generally indicated at 31. The left side portion 30 includes a handle portion 32 of the handle 27, a body portion 33, and a knuckle guard portion 34 of the knuckle guard 29. The right side portion generally indicated at 31 includes a handle portion 35 of the handle 27, a body portion 36, and a knuckle guard portion 37 of the knuckle guard 29. The upper housing section 23 includes a left body portion 38 and a right body portion 39. The actuator 28 is shown to comprise a lever 28' which is pivotally mounted on a post 40 passing through a through hole 41 in the lever 28'. The post 40 is disposed at the lower end portion of the handle portion 35 and the hole 41 is disposed at lower end portion 42 of the lever 28'. Upper portion 43 of the lever 28' has a pair of spaced arcuate gear sections or gears 44 and 45. The gear sections 44 and 45 mesh with gears 46 and 47 which in turn mesh with gears or racks 48 and 49 on the print head 24. A toothed driver 50 in the form of a feed wheel 51 having peripherally spaced teeth 52 is disposed between the gears 46 and 47. A ratchet wheel 53 (FIG. 16) is formed integrally with the feed wheel 51. The ratchet wheel 53 is not visible in FIG. 2 because it is on the far side of the feed wheel 51. The gears 46 and 47, the feed wheel 51 and the ratchet wheel 53 are coaxial along axis 54. The gears 46 and 47 are identical. The gear 47 has an integrally formed pawl 55 which cooperates with the ratchet wheel 53 to advance the feed wheel 51 stepwise. The gear sections 44 and 45, the gears 46 and 47, and the racks 48 and 49 are considered to provide gearing between the actuator 28 and the print head 24 and the feed pawl 55. This gearing is part of the drive connection between the actuator 28, the print head 24, and the driver 50. The integral feed wheel 51 and ratchet wheel 53 and the gears 46 and 47 are rotatable on a post 56 on the body portion 33. The post 56 is received in a recess 57 in the portion 36. The gears 46 and 47 are received on a shaft 57' which is integral with the feed wheel 51 and the ratchet wheel 53.

Figure 4:
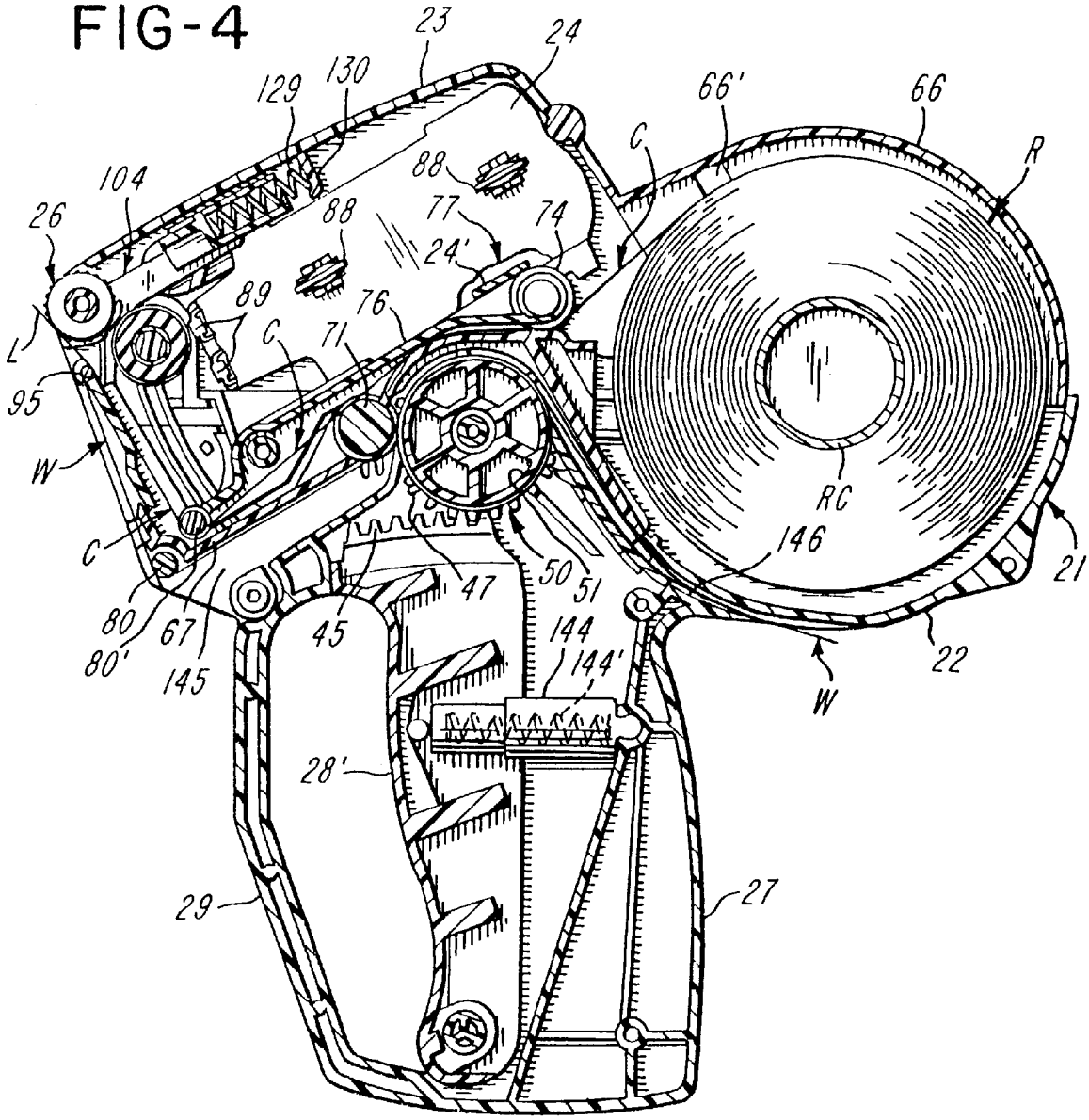
FIG. 4 is a vertical sectional view of the labeler.
Figure 5:
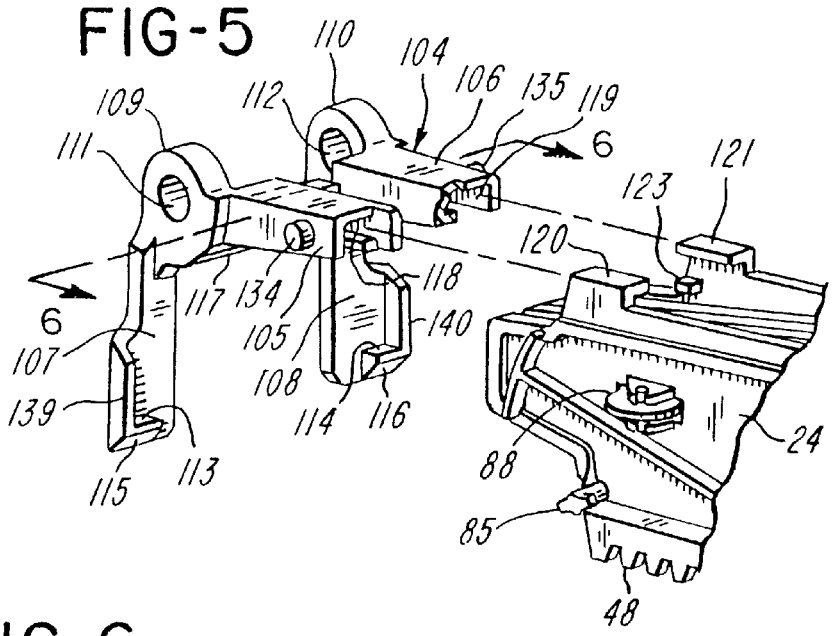
FIG. 5 is a fragmentary perspective view showing a fragmentary portion of the print head and a multifunctional member for latching the housing sections of the labeler, for guiding the print head and for preventing movement of the print head out of its initial position when the member is unlatched.

As shown in FIG. 4, a roll R of a composite label web C is shown to be mounted in the housing 21. The composite label web C is wound on a core RC and includes a series of labels L releasably adhered by pressure sensitive adhesive to a carrier web W.

Referring again to FIG. 2, the core RC is mounted on annular rings 58 and 59 rotatably mounted by a pair of identical roll mounting members 60 and 61. The mounting members 60 and 61 are biased toward each other by compression springs 62. The mounting members 60 and 61 are axially movable relative to each other and have respective pairs of cam followers 63 guided axially in opposed pairs of slots 64. The body portion 38 has cams 65 cooperable with the cam followers 63 when the upper housing section 23 is being opened and closed. When the upper housing section 23 is being opened from the position shown in FIGS. 1 and 4 to the open position shown in FIG. 13 the cams 65 acting 011 the cam followers 63 move the mounting members 60 and 61 apart to enable a label roll R to be inserted or to enable a spent core RC to be removed. When the upper housing section 23 is returned to its closed position, the springs 62 urge the mounting members relatively toward each other. It is readily apparent that the upper housing section includes a cover portion or cover 66. The user can see the amount of the roll R which is mounted inside the cover portion 66 by means of slots 66'. The arrangement for mounting the label roll R described above is the same as the arrangement disclosed in U.S. Pat. No. 4,668,326, the disclosure of which is incorporated herein by reference.

Figure 3:
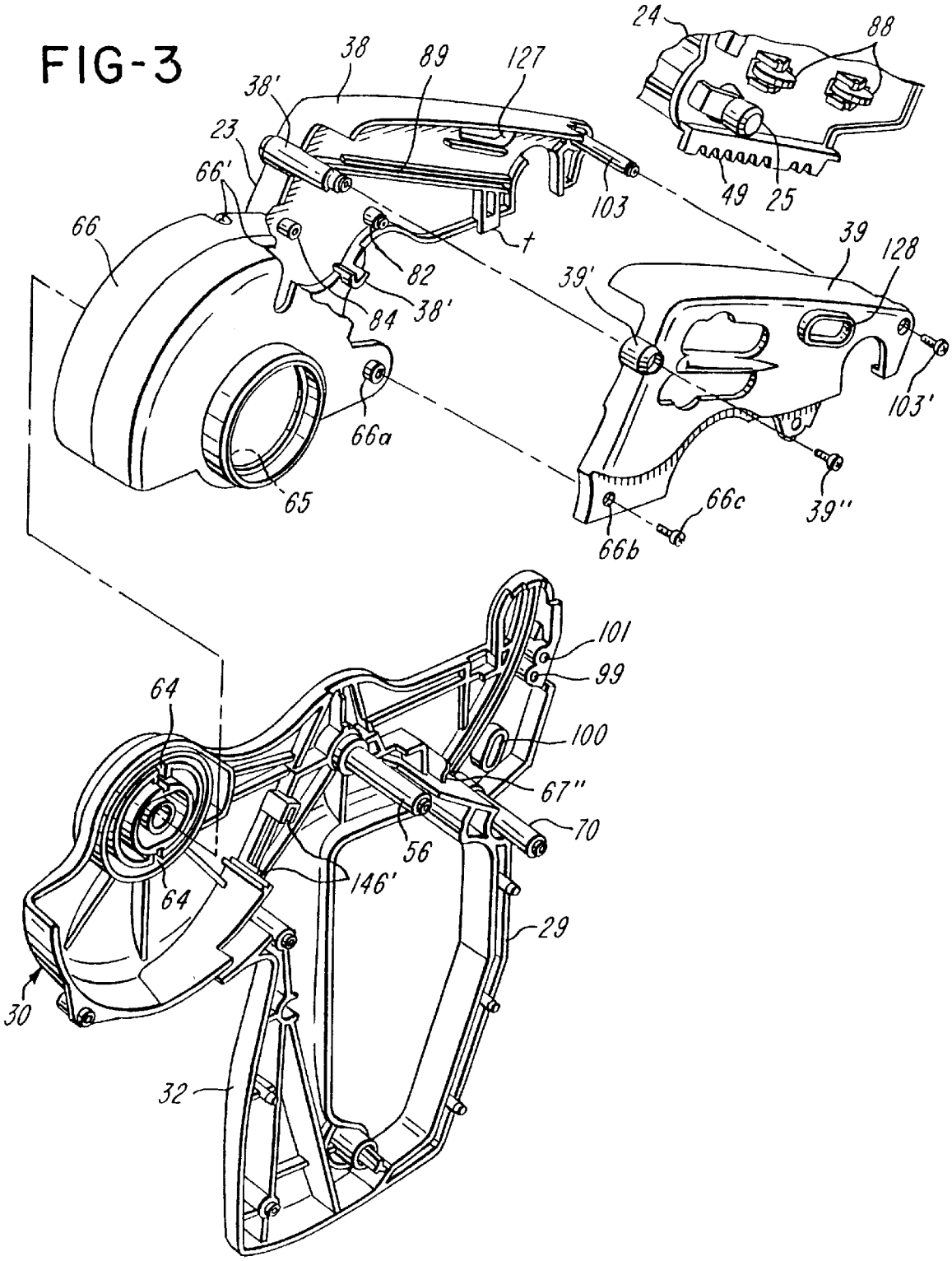
FIG. 3 is an exploded perspective view of certain components of the housing of the labeler.

FIGS. 2 and 4 show a one-piece multifunction member generally indicated at 67 which has an arcuate portion 68 received about and partially surrounding the toothed driver 50. The member 67 has a pair of spaced holes 69 by which the member 67 is pivotally mounted to a post 70 (FIG. 3). The member 67 also rotatably mounts a die roller 71 on spaced flexible arms 72. The member 67 includes a brake surface 73 with which a brake roll 74 cooperates, and further includes a guide surface 75 for the web C. The member 67 has opposed projections 67' which are releasably held to projections 67". The member 67 has a portion 68' with a finger-engageable recess 68".

A multifunction member 76 loosely rotatably mounts the brake roll 74. The brake roll 74 cooperates with the composite label web C and the brake surface 73 to provide a brake generally indicated at 77 (FIG. 4). The composite label web C passes between the brake roll 74 and the brake surface 73. The print head 24 has a transverse bar 24' which is in contact with the brake roll 74 when the print head 24 is at and near its initial position as shown in FIG. 4. The brake roll 74 is thus not able to rotate. In this position the bar 24' presses the brake roll 74 against the composite label web C which is in turn pressed against the brake surface 73. The bar 24' moves as a unit with the print head 24. When the print head 24 moves away from the initial position shown in FIG. 4, the bar 24' loses contact with the brake roll 74, and because the brake roll 74 is now free to rotate, the braking force is no longer applied to the web C and the web C is thus free to move under the brake roll 74. The member 76 (FIG. 2) has a through hole 78 which receives a mounting post 79 on the body portion 39. The member 76 rotatably mounts a direction changing or transfer roller 80'. The member 76 has opposed resilient C-shaped sockets 76' which secure the member 76 to the body 38 at connectors 38' (FIG. 3). The member 76 is positioned between the racks 48 and 49 and also serves as a guide for the web C when the labeler 20 is being threaded with a new web C.

Figure 6:
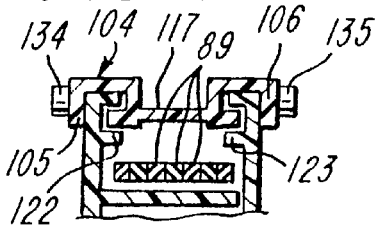
FIG. 6 is a sectional view taken along line 6—6 of FIG. 5.
Figure 12:
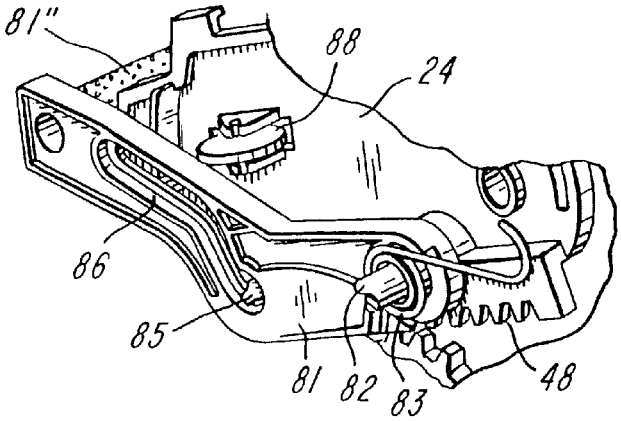
FIG. 12 is a fragmentary perspective view showing the manner in which the inker arm is mounted in relation to the print head.

An inker arm 81 (FIGS. 2 and 12) is pivotally mounted on a post 82 (FIGS. 3 and 12) passing through a hole 82'. A spiral spring 83 urges the inker counterclockwise. The spring 83 is connected to the inker arm 81 and to a post 84 (FIG. 3). The print head 24 carries a pin or driver 85 received and captive in a cam slot 86 in the inker arm 81. As the print head 24 moves from its initial position (FIG. 4) and its printing position in cooperation with a platen 87, the inker arm 81 pivots and an ink roller 81" mounted on inker shaft 81' inks printing members 89 (FIGS. 4 and 6). The printing members 89 are also inkable on the return movement of the inker arm 81.

Figure 14:
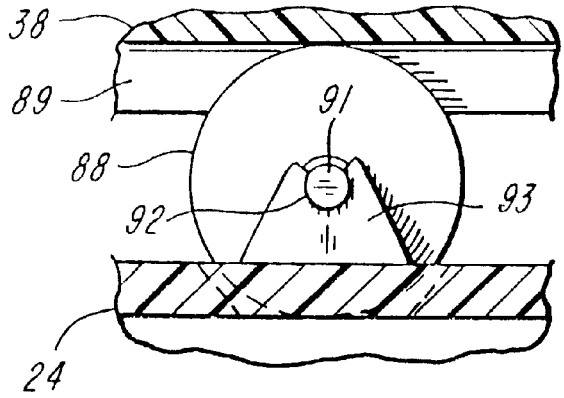
FIG. 14 is a fragmentary sectional view of a captive guide roller operating in a guide groove in the housing.
Figure 15:
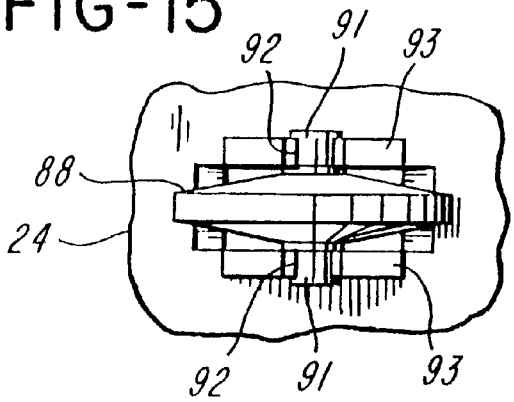
FIG. 15 is an elevational view of the roller and its mounting structure shown in FIG. 14.

As shown, the print head 24 has four identical guide rollers 88. There are preferably two rollers 88 connected to each side of the print head 24. Two of the rollers 88 are guided in and by a guide groove or track 89 (FIG. 3) and the other two rollers 88 are guided by a guide groove or track 90 (FIG. 2). With reference to FIGS. 14 and 15 in particular, each roller 88 has opposite, integrally molded stub ends 91. Each stub end 91 is snap-fitted into a C-shaped socket 92 in a respective mounting member 93. Thus, a pair of the mounting members 93 mounts each roller 88. Because the rollers 88 can be snap-fitted to the print head 24 during assembly, the manufacture and replacement of a print head is greatly facilitated over prior art ball strips which are loose and can impede assembly of the labeler 20. The rollers 88 remain connected to the print head 24 even through the housing 21 flexes or deflects, as for example when the labeler is dropped. Use of ball bearing strips in the labeler 20 could result in the ball bearing strips falling out of their tracks in the event the labeler 20 were dropped. Although FIGS. 14 and 15 show the construction of only one roller 88 and its associated mounting members 93, all four such rollers 88 and their mounting members 93 are identical. The rollers 88 preferably bottom in their respective guide tracks 89 and 90. The guide tracks 89 and 90 are preferably generally V-shaped and the tapering sides of the guide rollers 88 preferably have very straight clearance with the sides of the respective V-shaped guide tracks 89 and 90.

An assembly generally indicated at 94 (FIG. 2) which includes a platen 87, rotatably mounts a delaminator 95 in the form of a rotatable peel roller. The delaminator 95 is mounted in sockets 96. The assembly 94 has opposed locators 97 and 98. The assembly 94 can be used in a labeler 20 that has a two-line print head 24 for printing two lines of data as illustrated, or a one-line print head (not shown) for printing a single line of data. When it is desired to print with a labeler 20 with a two-line print head, the locators 97 and 98 are positioned in opposed locating recesses or locators 99 and 100, respectively. The locator 100 is an elongate recess. When printing in a labeler 20 with a one-line print head, the locators 97 and 98 are received in opposed locating recesses or locators 101 and 100 respectively. For such a one-line print head the applicator 26 is also positioned differently with respect to the delaminator 95.

The applicator 26 is shown to include a pair of applicators rolls 102, although a single applicator roll which is as wide as the two rolls 102 can be used. The rolls 102 are rotatably received on a post 103 the post 103 is molded integrally with the body portion 38. A multifunction member generally indicated at 104 is shown in FIGS. 2, 4, 5, 6, 7, 9, 11 and 13.

With reference to FIGS. 5, 6, 7 and 9, the member 104 has a pair of parallel arms or guides 105 and 106 and a pair of parallel latch members 107 and 108. The arm 105 and the latch member 107 are joined at a hub 109, and the arm 106 and the latch member 108 are joined at a hub 110. The hubs 109 and 110 have axially aligned holes 111 and 112 which receive the post 103 (FIG. 3). The hubs 109 and 110 straddle the applicator 26. The latch members 107 and 108 have respective teeth or latch shoulders 113 and 114 and cam faces 115 and 116. The hubs 109 and 110 are joined by an integrally molded bar 117. The arms 105 and 106 have respective guide channels 118 and 119 for receiving opposed angle-shaped projections 120 and 121 on the print head 24. In the initial position of the print head 24, the projections 120 and 121 are slightly short of the channels 118 and 119. Thus, the member 104 can pivot clockwise from the position shown in FIG. 5. It is noted that the print head 24 also has a pair of projections 122 and 123 which are in slidable contact with the undersides of the respective arms 105 and 106. As the print head 24 is driven from its initial position to the printing position at which the print head 24 cooperates with the platen 87 to print on a label L, the arms 105 and 106 cooperate with the projections 120 and 122, and 121 and 123, respectively to help guide the print head 24. This guiding of the print head 24 supplements the guiding of the print had 24 by the rollers 88 cooperating in guide slots 89 and 90. The arms 105 and 106 add stability to the print head 24 as it moves from its initial position to the printing position. It should be noted that when the projections 120 and 121 are in the guide channels 118 and 119, the member 104 cannot be moved and the latch members 107 and 108 cannot be unlatched from the teeth 136 and 137. The projections 120 through 123, or any of them, prevent unlatching of the upper housing section 23 from the lower housing section 22 unless the print head 24 is at or near its initial or home position. It should also be noted that the very small amount of movement of the print head 24 before either set of projections 120 and 121 or 122 and 123 is contacted by the ends of the arms 105 and 106 is insufficient to result in loss of registration between the racks 48 and 49 and the gears 46 and 47 either before or after the upper housing section 23 is moved to its closed position.

The left body portion 38 and the right body portion 39 are held together as a unit by the post 103 and a screw 103', by posts 38' and 39' and a screw 39", and by a stud **66*a* received in a hole 66*b* and a screw 66*c***.

Figure 9:
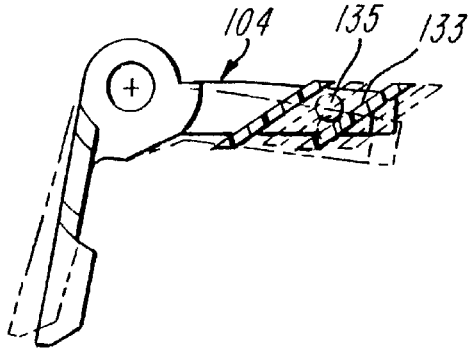
FIG. 9 is a side elevational view of the member shown in FIGS. 5 through 7 in solid line and phantom line positions.
Figure 10:
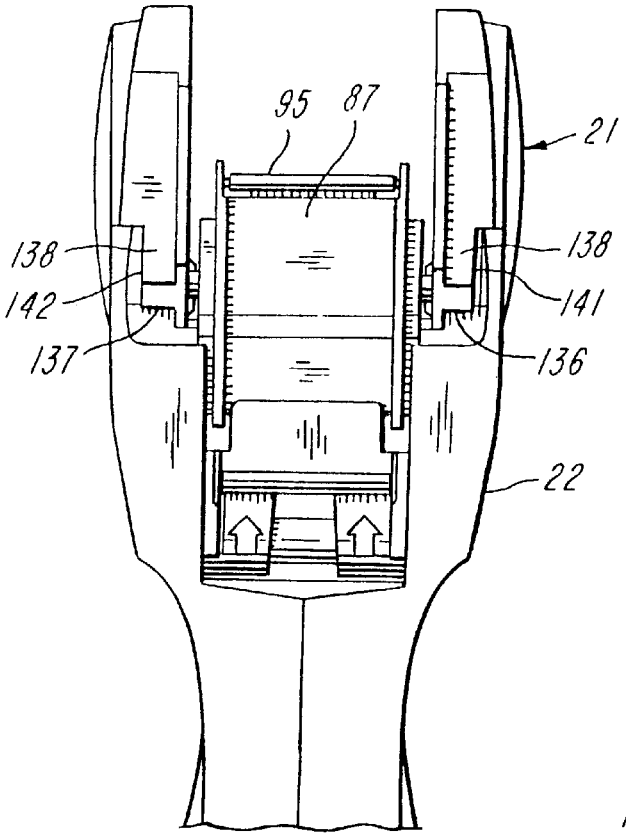
FIG. 10 is a front elevational view of the lower housing section of the labeler.
Figure 11:
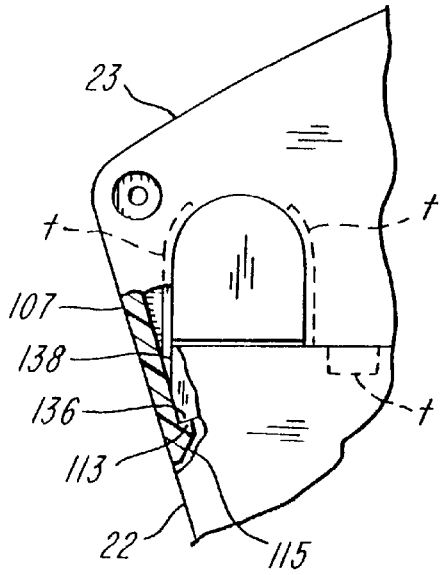
FIG. 11 is a fragmentary side elevational view showing the upper and lower housing sections latched to each other.
Figure 13:
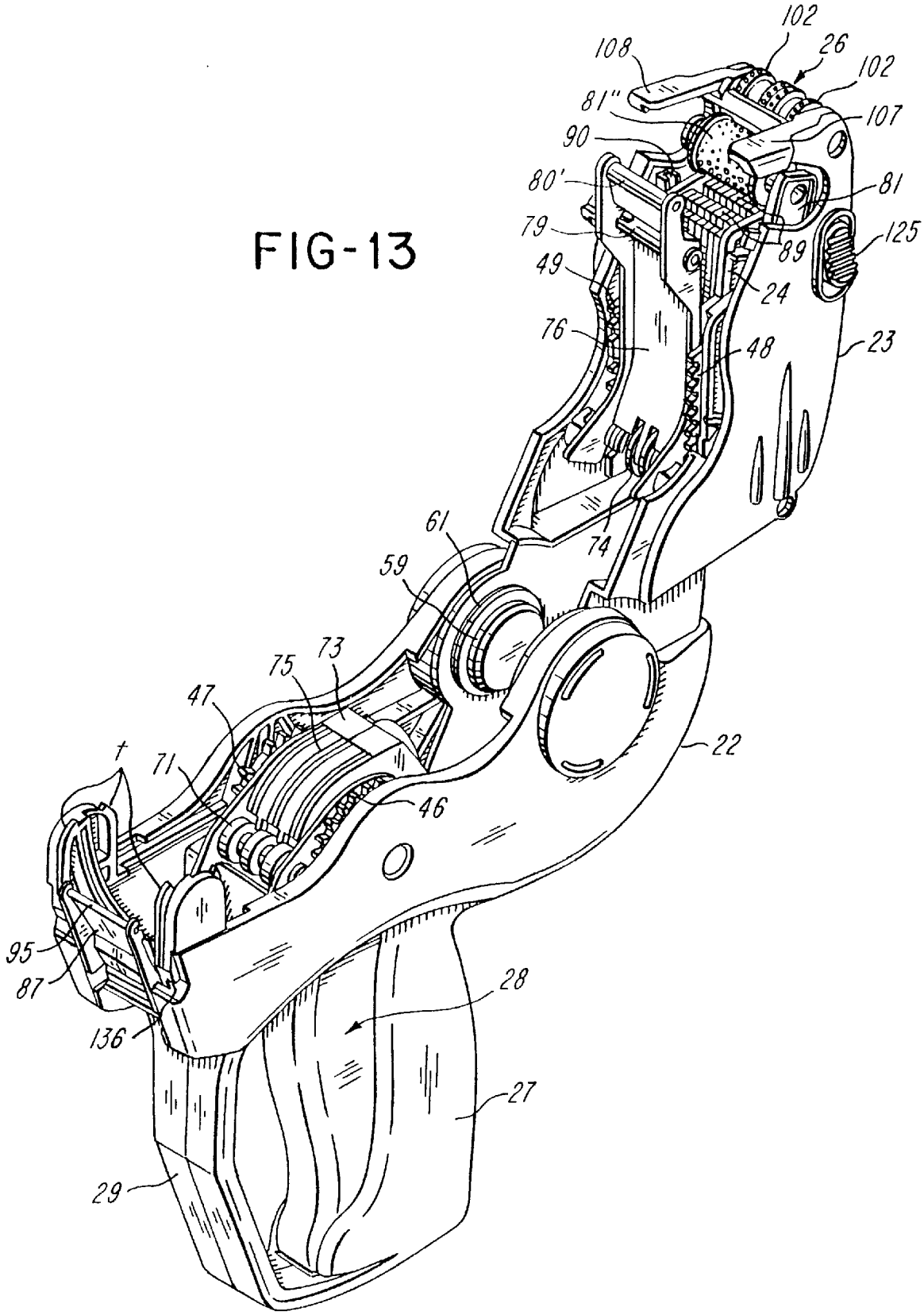
FIG. 13 is a perspective view of the labeler in its open position.

The member 104 is controlled by a manually engageable slide generally indicated at 124. The slide 124 has two finger-engageable projections 125 and 126 received in and guided in respective slots 127 and 128. A compression spring 129 bearing against a projection 130 on the body portion 38 is received in and bottoms in a pocket 131 in the slide 124. The spring 129 urges the slide 124 toward the front of the labeler 20. The slide 124 has a pair of opposed parallel channels 132 and 133 for receiving respective opposed projections or pins 134 and 135 on the arms 105 and 106. When the member 104 is in the solid line position as shown in FIG. 9, the spring 129 urges the member 104 counterclockwise. This holds the teeth 113 and 114 gripped to teeth 136 and 137 of the lower housing section 22. In order to release the latch members 107 and 108, the user grasps projections 125 and 126 and slides the slide 124 rearwardly against the action of the spring 129, and this causes the member 104 to pivot clockwise to the phantom line position shown in FIG. 9, thereby unlatching the upper housing section 23 from the lower housing section 22 and allowing the upper housing section 23 to be moved to a fully open position as shown in FIG. 13. When the upper housing section 23 is out of its operating or closed position, the spring 129 moves the member 104 to its phantom line position shown in FIG. 7; in this position the arms 105 and 106 are in the path of the projections 120 and 121 and the print head 24 is thus prevented from moving out of its initial position. This assures that when the upper housing section 23 is in its open or non-operating position or even in a partially open position, the registration between the racks 48 and 49 on the one hand and the gears 46 and 47 on the other hand is maintained. Thus, when the housing section 23 is moved into the closed position, the racks 48 and 49 remain registered with the gears 46 and 47. Likewise, if the slide 124 is moved against the action of the spring 129 while the housing section 23 is in the open position, the print head 24 will not move out of its initial position because the arms 105 and 106 are in the path of the projections 122 and 123 as shown in solid lines in FIG. 7, thereby preventing movement of the print head 124. The member 104 thus provides an interlock which enables the upper housing section to be unlatched in accordance with the user's desire, but prevents movement of the print head when the tipper housing section 23 is partially or fully open. In addition, the member 104 provides additional guiding of the print head 24 at the printing position where the print head 24 coacts with the platen 87.

It is noted that the cam faces 115 and 116 of the latch members 107 and 108 cooperate with the front surfaces 138 of the housing 21 as the tipper housing section 23 is moved into the closed position. Ledges 139 and 140 on the latch members 107 and 108 cooperate with housing surfaces 141 and 142 to help keep the Upper housing section 23 aligned with the lower housing section 22 when the tipper housing section 23 is in the closed position. The upper housing section 23 and the lower housing section 22 likewise have various cooperating ledges or tabs that the parting line 143 to align the upper housing section 23 with the lower housing section 22 as the upper housing section 22 is nearing the closed position and to assist in maintaining the housing sections 22 and 23 aligned.

In the position shown in FIG. 4, all the components are in their respective home or initial positions. A spring assembly 144, of the type shown at 515 in U.S. Pat. No. 4,104,106, has a return compression spring 144' that urges the actuator 28 to its home or initial position.

Figure 7:
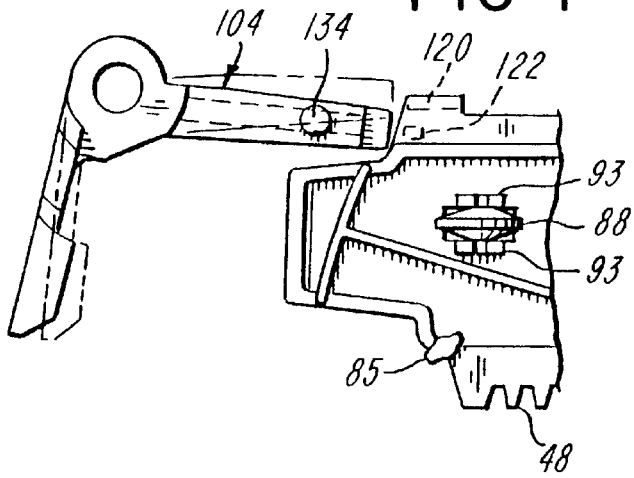
FIG. 7 is a side elevational view of the member shown in perspective in FIG. 5 in its unlatch positions.
Figure 8:
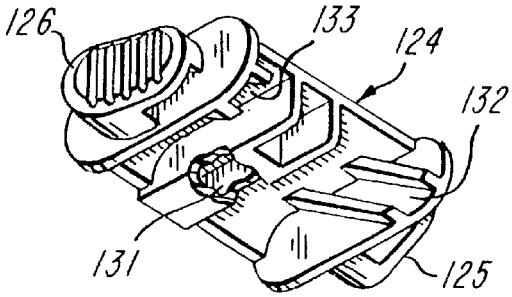
FIG. 8 is a perspective view of an actuator for the member showing in FIGS. 5 through 7.

In order to load the labeler 20, the user grasps the projections 125 and 126 and moves the slide 124 against the force of the spring 129 to pivot the member 104 clockwise to the solid line position in FIG. 7, thereby unlatching the upper housing section 23 from the lower housing section 22. The upper housing section 23 can now be pivoted to its open position. Upon release of the projections 125 and 126, the spring 129 returns the slide 124, and the member 104 moves to the position shown in phantom lines in FIG. 7. At the open position, the mounting members 60 and 61 have moved apart sufficiently to enable the roll R to be inserted and mounted on the rotatable rings 58 and 59. Thereupon, the composite label web C is laid over the brake surface 73, the guide surface 75, the delaminator 95 and beyond. Thereupon the upper housing section 23 can be closed and the web C inserted about roller 80 and into an inlet 145 (FIG. 4). From there the web C is passed between the feed wheel 51 and the die roller 71. The teeth 52 engage in holes (not shown) through the web C and the web C is advanced beneath arcuate portion 68 as the actuator 28 is repeated manually operated. The composite web C passes through an exit chute 146' and out of the labeler 20. As the tension in the composite web C increases, labels L are peeled or delaminated from the carrier web W at the delaminator 95. Thereafter, only the carrier web W passes about the delaminator 95 because labels L have been delaminated therefrom and labels L are dispensed into label applying relationship with respect to the applicator 26.

It is apparent that for each complete actuation of the actuator 27, the actuator 27 is driven from its initial position to its actuated position. The gears 46 and 47 rotate and the print head 24 is first moved to the printing position in cooperation with the platen 87. During the movement to the gear 47, the pawl 55 moves to a ready position shown at 55' in FIG. 16 at which a tooth 53' of the ratchet wheel 53 can be driven by the action of the spring assembly 144 when the actuator 27 is released. Thereupon, the pawl 55 advances the ratchet wheel 53 to advance the web W and advance the just printed label L from the printing position to the label applying position in underlying relation to the applicator 26. It is to be noted that a deflector 146 helps to release the web W from the teeth 52 on the feed wheel 51. The deflector 146 is secured in opposed pairs of pockets 146'. An anti-backup pawl 147 molded integrally with the deflector 146 prevents retrograde movement of the ratchet wheel 53 and its associated feed wheel 51, thereby preventing loss of tension in the feed path between the brake 77 and the feed wheel 51.

The labeler 20 is composed entirely of molded plastics material except for springs 83 and 129, spring 144' within the spring assembly 144, various screws, the elastomeric printing members 89, the elastomeric applicator rolls 102, and the outer elastomeric part of the brake roll 74.

Figure 17:
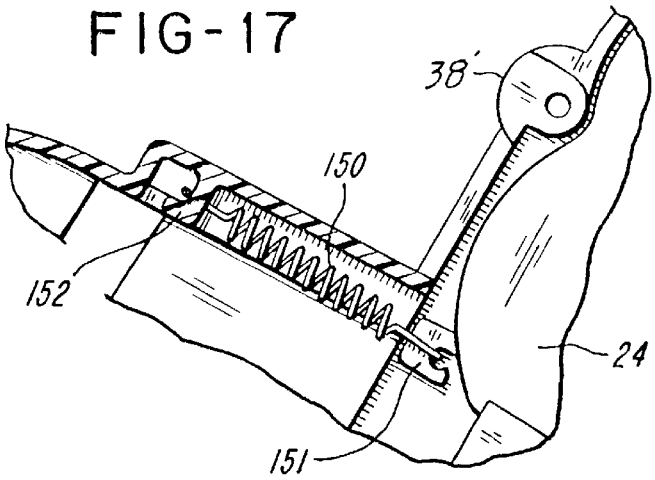
FIG. 17 is an enlarged fragmentary sectional view showing the manner in which the print head is biased according to an alternative embodiment.
Figure 18:
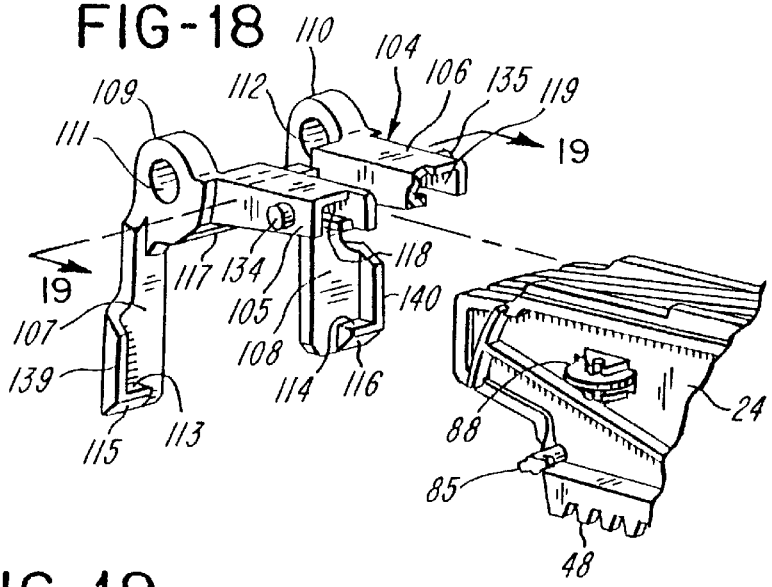
FIG. 18 is a view similar to FIG. 5 but showing the alternative embodiment.
Figure 19:
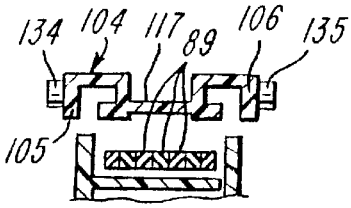
FIG. 19 is a view taken along line 19—19 of FIG. 18.
Figure 20:
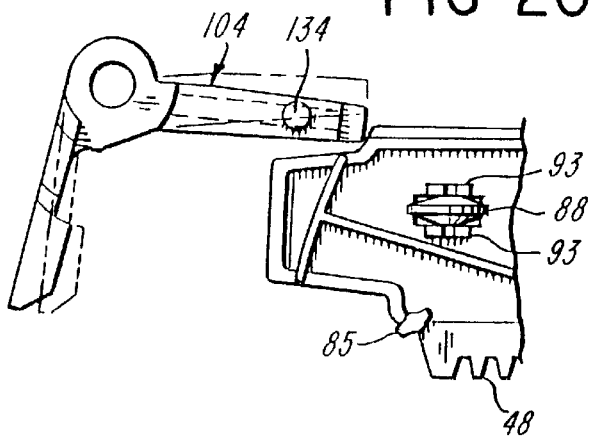
FIG. 20 is a view similar to FIG. 7, but showing the alternative embodiment.

With respect to the embodiment of FIGS. 17 through 20, it is apparent that the projections 120 through 124 have been eliminated. As shown in FIG. 17, a tension spring 150 is connected at one end to a hook 151 on the print head 24 and to a hook 152 on the upper housing portion 23. The spring 150 urges the print head 24 against the transverse post or boss 38' (FIGS. 4 and 17) when the upper housing portion 23 is in the other than the closed or operating position. When the upper housing portion 23 is moved into the closed position the teeth of the racks 48 and 49 and gears 46 and 47 cam the print head 24 exactly into its initial position. There is slight clearance between the boss 38' and the print head 24 when the upper housing portion 23 is in its closed position as shown in FIG. 17. This slight clearance is not enough to prevent the racks 48 and 49 and the gears 46 and 47 from meshing when the upper housing portion 23 is moved to the closed position but it is enough to prevent the print head 24 from striking the boss 38' each time the actuator 28 is fully actuated. The spring 150 assures that the print head 24 is always near or essentially at its initial position when the upper housing portion 23 of the labeler 20 is in other than the closed or operating position. This avoids loss of registration or timing between the gears 46 and 47 on the one hand and gears or racks 48 and 49 on the other hand. The force of the spring 150 is overcome when the actuator 28 is operated and the print head 24 is driven or moved to the printing position in cooperation with the platen 87. The spring 150 holds the print head 24 near or essentially at its initial position unless the second housing section is in its closed position. If the second or tipper housing section 23 is open and the labeler 20 is dropped, the print head 24 may move out of its initial position momentarily but the spring 150 will automatically return the print head 24 to near or essentially at its initial position. The return spring 144' can be lighter than would be the case if no spring 150 were used. It is seen that the return springs 144' and 150 comprise the forces used to reliably return the moving components to their initial positions and to advance the composite label web C. In other respects the embodiment of FIGS. 17 through 20 is the same as the embodiment of FIGS. 1 through 16.

Figure 21:
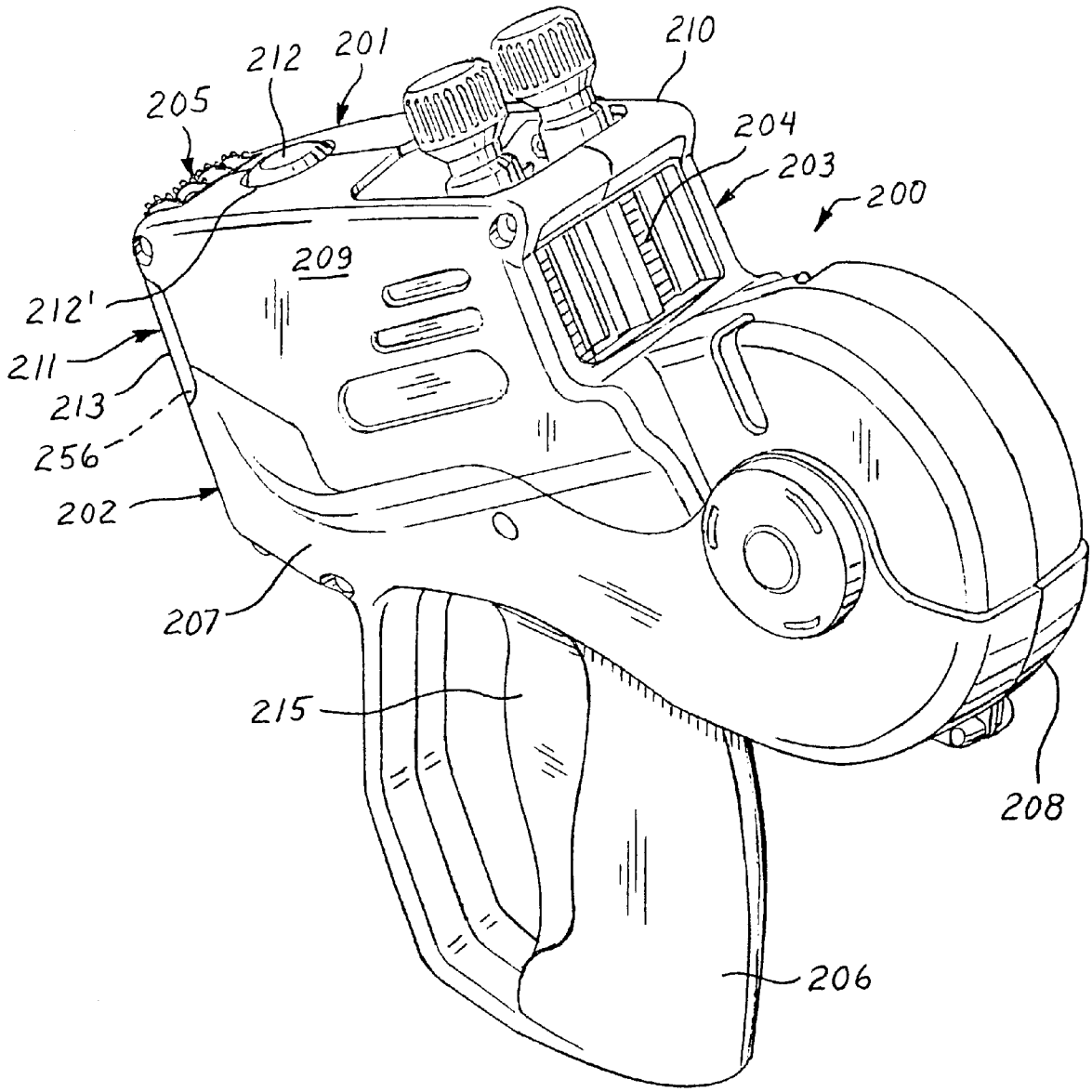
FIG. 21 is a prospective view of another embodiment of a handheld labeler of the invention.
Figure 25:
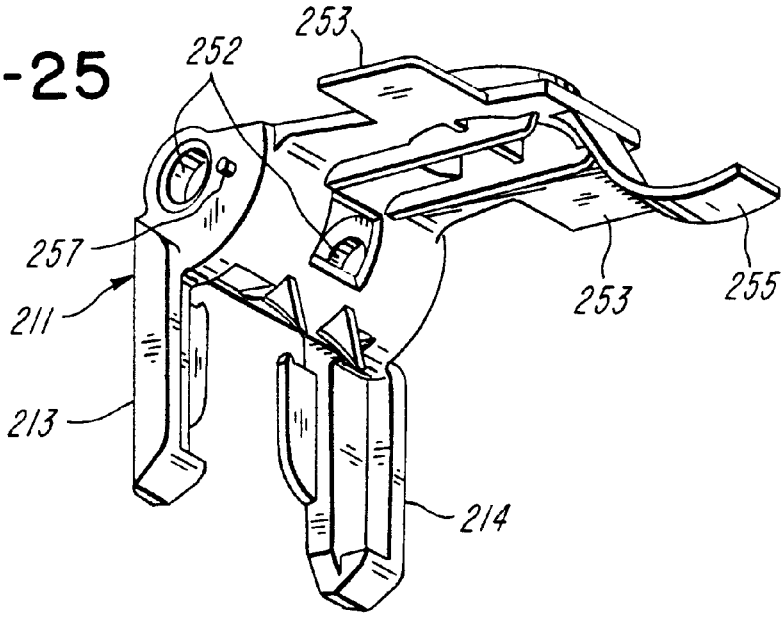
FIG. 25 is a perspective view of a latch of a latching mechanism also shown in FIGS. 21, 22 and 24.
Figure 27:
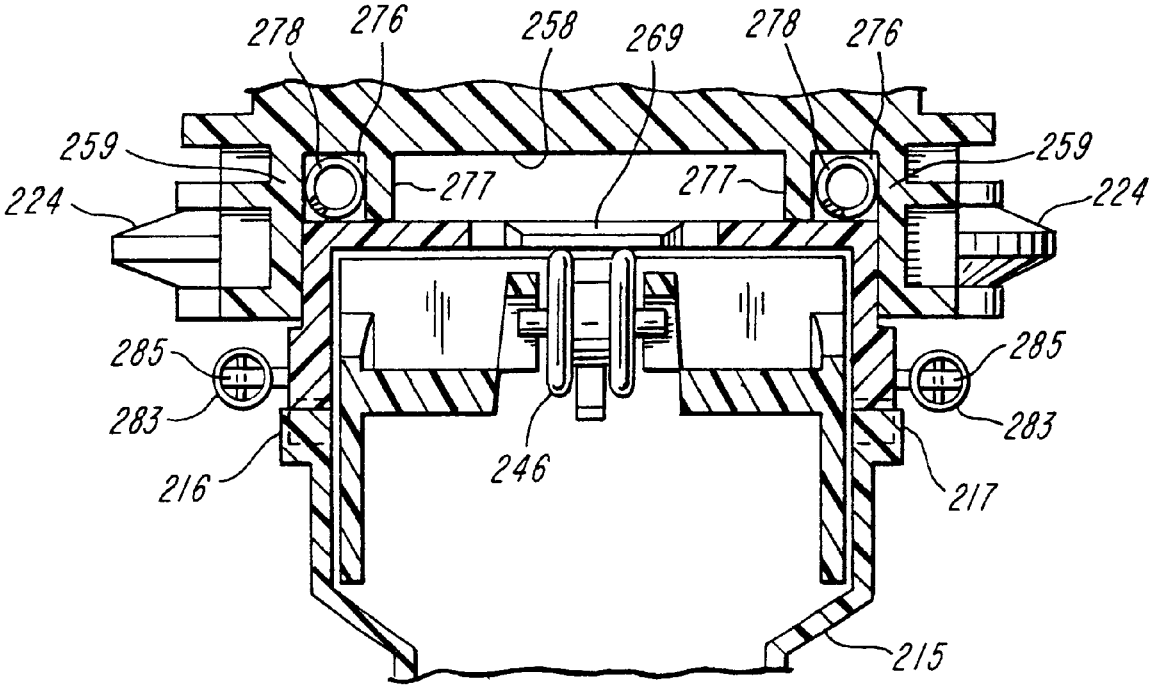
FIG. 27 is a sectional view showing components of the impression control mechanism, the guide rollers, and fragmentary portions of the print head and the actuator.

With reference to FIG. 21, there is shown a hand-held labeler generally indicated at 200 which is the same as the labeler 20 except to the extent different structure is shown and described in the drawings and the specification and claims of the present application. The labeler 200 has a housing or frame generally indicated at 201 having a first or lower housing section 202 and a second or upper housing section 203. The housing 201 is shown to mount a two-line print head 204 although the labeler 200 can accept one-line and three-line print heads as well. An applicator 205 is disposed at a front portion of the housing 201. The housing 201 has a downwardly extending manually graspable handle 206. The lower housing section 202 includes a left body portion 207 and a right body portion 208. The upper housing section 203 includes a left body section 209 and a right body section 210. A latch generally indicated at 211 includes a depressible button 212 and a pair of parallel latch members 213 and 214 (FIGS. 22 and 25).

Figure 22:
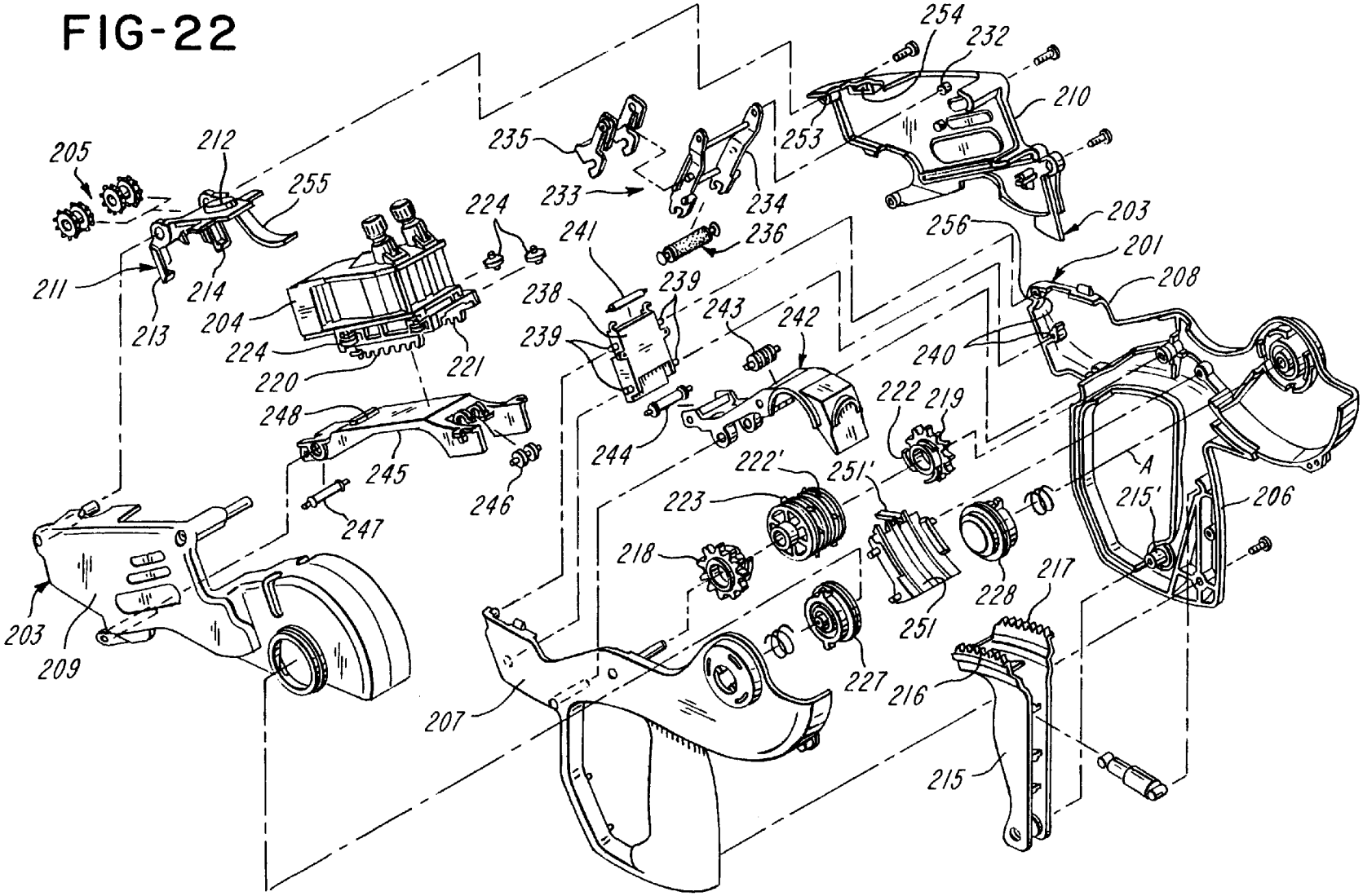
FIG. 22 is an exploded perspective view of the labeler depicted in FIG. 21.

With reference to FIG. 22, there is shown an actuator 215 having a pair of gear sections 216 and 217. The actuator 215 is pivotally mounted on posts 215'. The gear sections 216 and 217 mesh with gears 218 and 219 which in turn mesh with racks or gear sections 220 and 221. Three pawls 222 coaxial and integral with the gear 219 cooperate with a ratchet wheel 222' on a feed wheel 223. The ratchet wheel 222' is similar to the ratchet wheel 53 except it is an internal ratchet wheel rather than an external ratchet wheel as is the ratchet wheel 53.

The print head 204 mounts rollers 224 which roll in opposed guides 225 and 226 (FIG. 23) in respective right and left body portions 210 and 209. The upper housing section 203 is pivoted on an axis A as in the embodiments of FIGS. 1 through 20. The label roll R is mounted by a pair of mounting members 227 and 228. Each of the mounting members 227 and 228 also mounts a disc 229 (FIG. 39) having a plurality of lobes 230. The discs 229 prevent excessive telescoping of the roll R during use.

The body portions 209 and 210 have aligned internal posts 231 (FIG. 23) and 232 (FIG. 22) received in aligned holes 231' and 232' (FIG. 32) for pivotally mounting an inker generally indicated at 233. The inker 233 includes a pair of holders 234 and 235, an ink roller 236, and a leaf spring 255 which forms part of the latch 211. The print head 204 is movable into and out of printing cooperation with a platen 238 which is secured by pins 239 into holes 240 of body portions 209 and 210. The platen 238 also rotatably mounts a delaminator 241 in the form of a peel roller.

A multi-function member 242, corresponding to the member 67, includes a die roll 243 and a direction changing roll 244. A member 245 mounts a brake roll 246, a direction changing roll 247 and an abutment 248 which is part of the impression control mechanism or device 249 (FIGS. 26 through 31).

Figure 24:
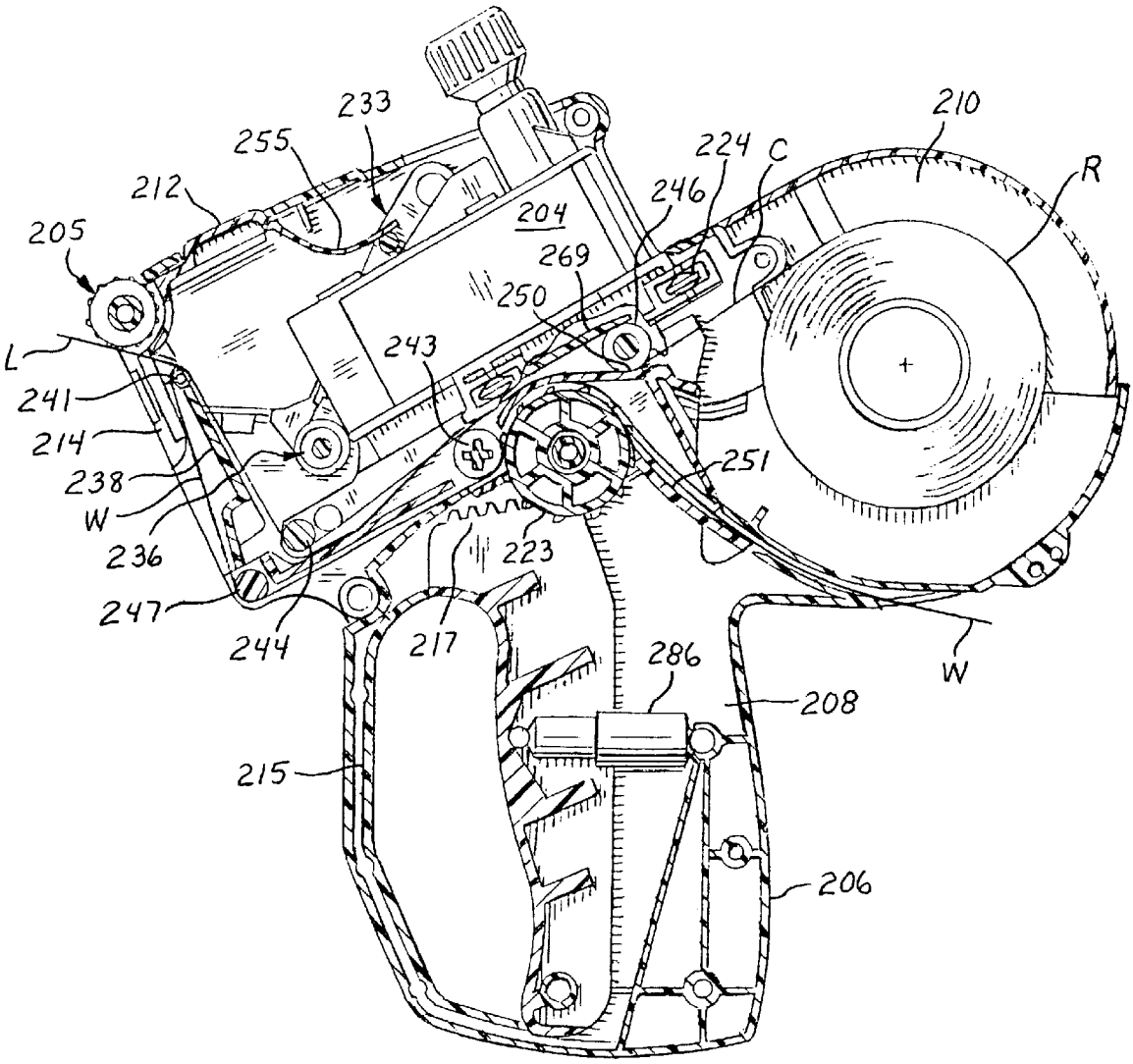
FIG. 24 is a sectional elevational view of the labeler shown in FIGS. 21 through 23.

With reference to FIG. 24, which is similar to FIG. 4, the composite web C passes from the roll R between the brake roll 246 and a brake surface 250, partially about roll 244, over the platen 238 and to the delaminator 241 where labels L are successively delaminated from the web W. Each delaminated label L is presented into underlying relationship to the applicator 205. The leading label L is delaminated as the carrier web W passes partially about the delaminator 241. From there the web W passes partially about the roll 247, partially about the die roller 243 and the feed wheel 223 and from there the web passes over a stripper and guide 251 which includes an integral anti-backup pawl 251' cooperable with the ratchet wheel 222'.

Figure 23:
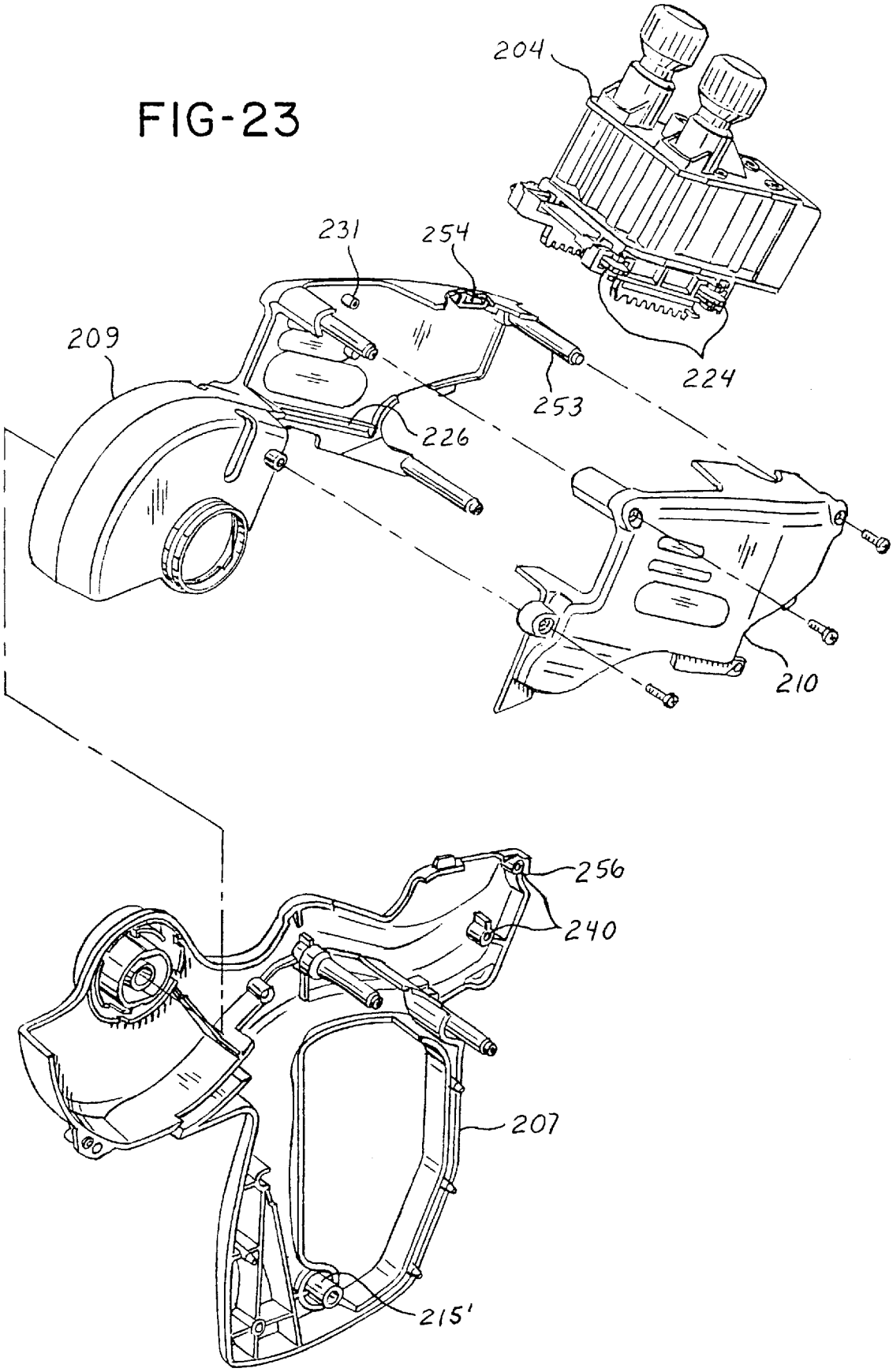
FIG. 23 is an exploded perspective view of certain components of the labeler shown in FIGS. 21 and 22.

With reference to FIG. 25, the latch 211 is shown to be of one-piece molded plastics construction. The latch 211 has aligned holes 252 which receive aligned posts 253. Integrally formed leaf springs 253 are received in pockets or slots 254 (FIGS. 22 and 23). The latch also has an arcuate leaf spring 255 which forms part of the inking mechanism or inker 233. The integrally formed button 212 is accessible from outside the housing 201 through a hole 212' as shown in FIG. 21. The latch members 213 and 214, like the latch members 107 and 108, grip teeth 256 which are identical to the teeth 136 and 137. When the button 212 is manually depressed, the latch member 213 and 214 pivot outwardly to unlatch the upper housing section 203 from the lower housing section 202 with accompanying flexure of the leaf springs 253. When the button 212 is no longer depressed, the leaf springs 253 return the gripper members 213 and 214. In the event the upper and lower housing-sections 203 and 202 are in their closed or operating positions, the latch members 213 and 214 will engage the teeth 256 to hold the housing sections 202 and 203 latched. Opposed pairs of pins 257 (only one of which is shown) cooperate with the body portions 209 and 210 to limit pivoting movement of the latch 211 when the button is depressed.

Figure 26:
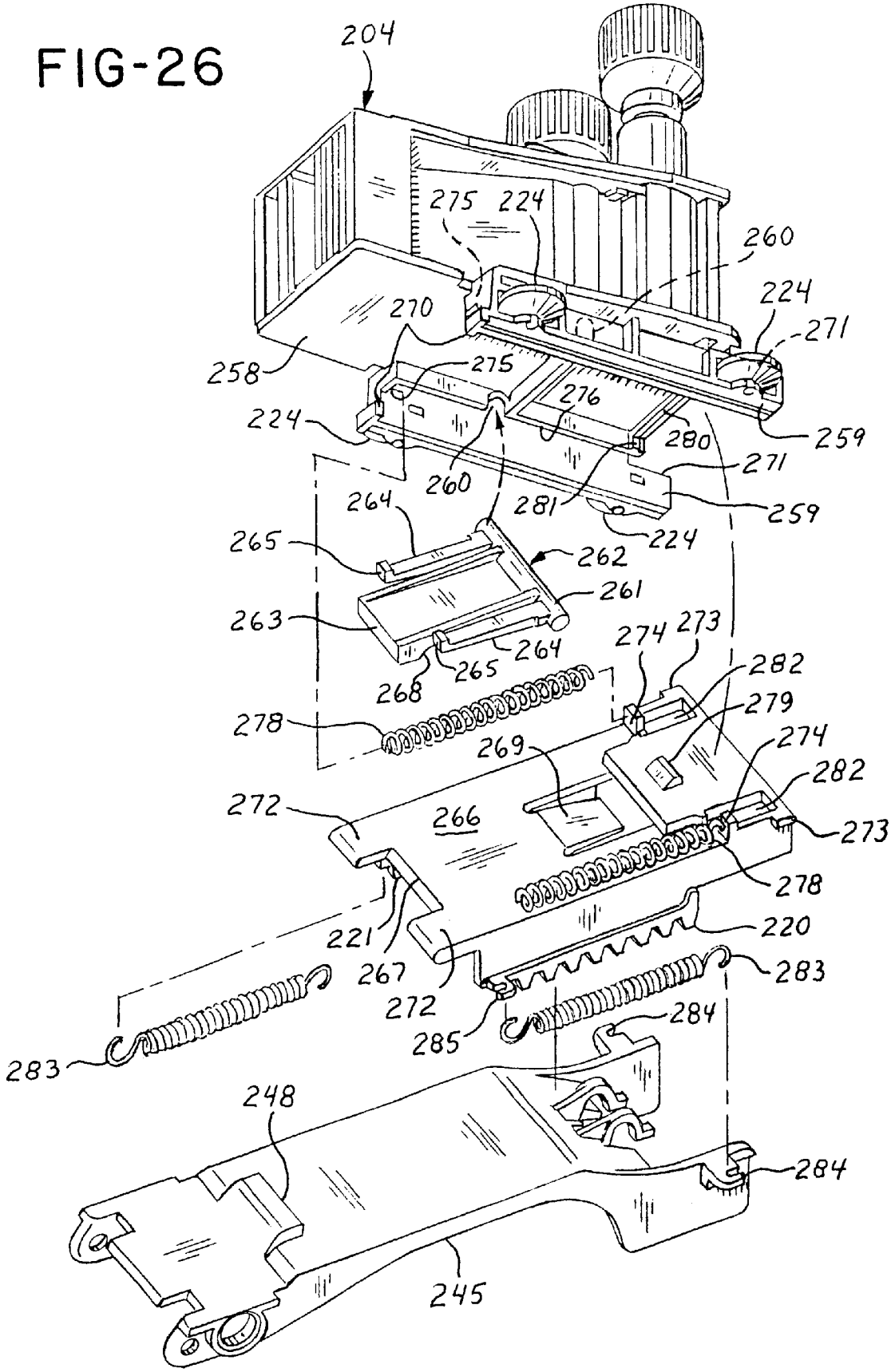
FIG. 26 is an exploded partly rotated view of an impression mechanism and the print head.

With reference to FIG. 26, there is shown the impression control mechanism 249 for the print head 204. The purpose of the mechanism 249 is to assure that proper printing pressure is applied to the labels L against the platen 238 irrespective of the speed of operation of the actuator 215 or the force applied to the actuator 215 by the user. The printing pressure is thus consistent for each printing cycle and is independent of any control by the user. As shown, the print head 204 includes an end or side plate 258 with which flanges 259 are integrally molded. The flanges 259 rotatably mount the guide wheels 224. There are pockets 260 in the flanges 259 adjacent the side plate 258 which receive a pivot portion 261 of a pawl or toothed member 262. The pawl 262 has a tooth 263 which is cooperable with the abutment 248 (FIGS. 22 and 28 through 31). The pawl 262 also includes a pair of spaced leaf springs 264 connected to the pivot portion 261. The pawl 262 is on one-piece molded plastics construction. The leaf springs have pads 265 which bear against the side plate 258. The pivot portion 261 is held in place against a plate or slide 266 as shown in FIG. 28 for example. The slide 266 has a trip surface 267 which is cooperable with a cam surface 268 on the underside of the tooth 263. The slide 266 also has a leaf spring 269 which cooperates with the brake roll 246 when the print head 204 is at and near its initial or home position shown in FIG. 24. The flanges 259 have projections 270 and parallel land surfaces 271. The slide 266 has projections 272 and 273. The projections 272 of the slide 266 are supported by the projections 270 and the lands 271 support the projections 273. As is apparent, the slide 266 is disposed between the projections 270 and the side plate 258. The slide 266 has two shoulders 274 and the flanges 259 have two shoulders 275. The shoulders 275 are at the end of a pair of channels 276 formed by the end plate 258, by the flanges 259 and by flanges 277. The channels 276 receive compression springs 278. Each spring 278 bears against one shoulder 274 and one shoulder 275 to urge the plate 266 and the print head 204 in opposite directions. The slide 266 and the print head 204 are, however, prevented from separating by a tooth 279 (FIG. 26) which encounters an abutment 280 and by projections 281 (only one of which is shown) received in elongate channels 282. The flanges 259 provide a holder for the slide 266, the pawl 262 and the springs 278.

In order to assure that the print head 204 is brought to the home or initial position after the upper housing section 203 has been opened and before it is closed, tension springs 283 (FIGS. 26 and 27) connected to hook portions 284 on the member 245 and to hook portions 285 on the slide 266 are provided. These springs 283 are additive to the force applied to the actuator 215 by spring device 286 (FIGS. 22 and 24).

With reference to FIGS. 28 through 31, and initially to FIG. 28, wherein the print head 204 and the slide 266 are in their initial or home positions, the trip surface 267 is spaced from the cam surface 268, and the pawl 262 is spaced from the abutment 248. The print head 204 is spaced its maximum distance from the platen 238. Also the ink roller 236 is between the print head 204 and the platen 238 as shown in FIG. 24. When the actuator 215 is pivoted clockwise (FIG. 24), the gear sections 216 and 217 rotate the gears 218 and 219 when in turn move the slide 266, the print head 204 and the pawl 262 to the left as a unit as viewed in FIG. 28. With reference to FIG. 29, movement of the print head 204 and the pawl 262 is arrested in spite of continued movement of the actuator 215 when the tooth 263 contacts the abutment 248. While the print head 204 moves toward the platen 238, the ink roller 236 inks the print head 204 and the inker 233 is pivoted out of the way by the print head 204. Although the compression springs 278 are slightly loaded even in their initial position (FIG. 28) continued movement of the actuator 215 continues to move the slide 266 to further load the springs 278 until such time in the cycle when the trip surface 267 acts on the cam surface 268 to move the pawl 262 to the position shown in FIG. 30. Thereupon, the loaded springs 278 drive the print head 204 and the pawl 262 further to the left to the position shown in FIG. 31 to cause the print head 204 to impact the platen 238. When the user releases the actuator 215, the spring device 286 and the springs 283 return the actuator 215, the gears 218 and 219, the print head 204, the impression control mechanism 249 and the inker 233 to their initial positions, and the pawls 222 drive the ratchet wheel to advance the feed wheel 223 and the composite web C.

With reference to FIGS. 32 through 34, there is shown a carrier 287 comprised of holders 234 and 235. The holder 234 includes laterally spaced holder members 288 having aligned posts or pivots 289 received in holes 290 in the holder 235. The holder member 234 has aligned posts or abutments 291. Rods 292 and 293 connect the holder members 288 to each other. The rod 292 has a smooth central portion 294 against which the leaf spring 255 bears. The holder members 288 have a pair of arcuate surfaces or openings 234' with relatively wide open entrances defined by surfaces 295 and 296 and hooks 297. Cam surfaces 298 terminate at the surface 295. Openings 234' are larger than annular portions 315 of the ink roller 236.

The holder 235 has laterally spaced holder members 299 connected by a bar 300 with a finger-engageable tab 301. The holder members 299 have cam surfaces 302 which lead into arcuate openings 303. The openings 303 are larger than the annular portions 316 of ink roller 236. Leaf springs 304 act on posts 291 to urge the holders 234 and 235 into their closed positions shown in FIG. 33. FIG. 34 shows the carrier 287 as rotatably mounting the ink roller 236. To insert an ink roller 236, the user clamps the ink-free flanges 317 between his/her thumb and index fingers of one hand, and pushes the ink roller 236 against cam surfaces 298 and 302 to spread the holders 234 and 235 to enable the ink roller 236 to move into the operating position shown in FIGS. 34 and 36. To release the ink roller 236, the user simply depresses the tab 301 to flex the springs 304 to release the ink roller 236. The openings at surfaces 234' and 303 are larger than the diameters of respective annular portions 316 and 315 of the ink roller 236.

With reference to FIGS. 35 and 36, there is shown the ink roller 236 in greater detail. The ink roller 236 has an annular supporting member 305 having closely spaced capillary ink-retaining chambers 305' as best disclosed in U.S. Pat. No. 5,906,161 incorporated herein and made a part of this application by reference. The supporting member 305 has an annular supporting surface 306 about which is snugly received a porous ink-receptive sleeve 307. End portions 308 of the member 305 are free of chambers 305' so that the sleeve 307 completely seals off ink flow between the sleeve 307 and end portions 308. The ink roller 236 is shown to have a pair of preferably identical end sections generally indicated at 309. The end sections 309 are connected to the supporting member 305. Each end section includes a flange 310 and an annular projection or ring 311. Together, the flange 310 and the annular projection 311 provide a cup-shaped portion which fits onto the end portions 308 of the supporting member 305. In fact, the annular projections 311 contact and make a close fit with the end portions 308. Although the projections 311 are shown as being continuous and annular, each projection can be a single relatively short projection in the circumferential direction or there can be two or more circumferencial projections instead of one annular projection. While the projections 311 provide desirable stability to the connection between the sections 309 and the supporting portion 305, a projection or projections are not essential in view of the use of prong or prongs 312. In addition, the end sections 309 are further attached to the supporting member 305 by a prong 312 received in a hole 313 on the supporting member 305. Although two holes 313 are preferably provided to avoid weakening the supporting member 305, a single through-hole can be provided if desired. The projections 311 and the prongs 312 extend in an inward direction from the flange 310. A shoulder 314 on the outside of each flange 310 can bear against the respective holder members 288, and the shoulders 314 prevent the flanges 310 from rubbing on the holder members 288. Annular portions 315 provide bearing surfaces which ride or bear on the surfaces 234' of the holder members 288. Reduced diameter annular portions 316 provide bearing surfaces which ride or bear on the surfaces 303 of the holder members 299. A disc-shaped flange 317 is connected to the annular portion 316. The shoulder 314 has a lesser radial extent or diameter than the flange 310 but a greater radial extent or diameter than the annular portion 315. The annular portion 315 has a greater radial extent or diameter than the annular portion 316. The annular portions 315 and 316 are considered to constitute a shaft portion. The flange 317 has a greater radial extent or diameter than the shoulder 314 but a lesser radial extent or diameter than the flange 310. The shoulder 314 is disposed between the flange 310 and the annular portion 315, the annular portion 315 is disposed between the shoulder 314 and the annular portion 316, and the annular portion 316 is disposed between the annular portion 315 and the flange 317. The annular portion 316 is longer than the annular portion 315. The prong 312, the hole 313, the flange 310, the shoulder 314, the annular portions 315 and 316, the flange 317, and the supporting member 308 are all coaxially aligned and lie along a central axis CA. If desired, the one end section 309 can be formed integrally with the supporting member 305. It is contemplated by this disclosure that both end sections 309 can be integral but then undesirably the sleeve 307 would be required to be slipped over the flange 310. The supporting member 305 is preferably of one-piece molded plastics construction. Each end section 309 is preferably of one-piece molded plastics construction.

FIG. 38 shows a prior art carrier 320 for an inker as used in a hand-held labeler according to U.S. Pat. No. 4,280,863. The carrier 320 is used with a prior art ink roller 321 which includes a sleeve of porous ink-receptive material 322, flanges 323, shoulders 324 (only one of which is shown) and a short annular portion or shaft portion 325. The carrier 320 is pivotable about pivots 326 (only one of which is shown) and has C-shaped sockets 327 with lead-in cam surfaces 328 for receiving shafts 325. The diameter of the shaft portions 325 is less than the opening into the sockets 327. Of course, because the molded plastics carrier 320 is flexible and resilient the opening into the sockets 327 enlarges to receive the shaft portions 325 when the ink roller 321 is being inserted. The ink roller 321 can be removed by flexing one or both members 329 so that one or both shafts 325 lose contact with the socket or sockets 327. The ink roller 236 is compatible with both the carrier 234 and the carrier 320. As shown in FIG. 37, the annular portions 315 of the ink roller 236 bear against and are received in the sockets 327. By flexing the members 329 in the direction of arrows D one or both of the sockets 327 align with one or both annular portions 316. The diameter of the annular portions 316 is less than the opening into the sockets 327 so the ink roller 236 will just fall out when it is desired to release the ink roller 236 by twisting or flexing the carrier 320 as indicated.

Other embodiments and modifications of the invention will suggest themselves to those skilled in the art, and all such of these as come within the spirit of this invention are included within its scope as best defined by the appended claims.

What is claimed is:

1. An inker comprising: a carrier including a first holder having a pair of spaced first holder members, at least one first member connecting the first holder members, each first holder member having a pair of first holder surfaces, a second holder movably mounted on and relative to the first holder, the second holder having spaced second holder members, at least one second member connecting the second holder members, each second holder member having a pair of second holder surfaces, an ink roller held between pairs of first and second holder surfaces, and at least one spring for urging the first and second holders to a holding position but being relatively movable against the urging of the spring to move the holders to a release position in which the pairs of first and second holder surfaces are spaced to release the ink roller.

2. An inker as defined in claim 1, wherein the second holder is pivotally mounted on the first holder, wherein the second holder has a pair of leaf springs acting against the first holder to urge the first and second holders to an ink roller holding position.

3. An inker as defined in claim 2, wherein the holder members provide cam surfaces which enable the ink roller to move the holders relative to each other as the ink roller is being inserted to the holding position.

4. An inker as defined in claim 1, wherein the second holder is pivotally mounted on the first holder.

5. An inker, comprising: a carrier including a first holder having first holder surfaces, a second holder movable relative to the first holder and having second holder surfaces, an ink roller having shaft portions, each shaft portion having an adjacent pair of bearing portions of different radial extents, each pair of bearing portions being received by one pair of the first and second holder surfaces, the first and second holders being relatively spring biased to urge the first and second holder surfaces into holding relationship to the pair of bearing portions, and the holders being movable against the biasing to move the first and second holder surfaces apart to release the ink holder.

* * * * *